US007005612B2

(12) United States Patent
Han

(10) Patent No.: US 7,005,612 B2
(45) Date of Patent: Feb. 28, 2006

(54) IGNITER AND DRYER THEREWITH

(75) Inventor: In Hee Han, Changwon-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/703,670

(22) Filed: Nov. 10, 2003

(65) Prior Publication Data

US 2004/0134093 A1 Jul. 15, 2004

(30) Foreign Application Priority Data

Jan. 14, 2003 (KR) ..... 10-2003-0002457
Feb. 21, 2003 (KR) ..... 10-2003-0011051

(51) Int. Cl.
*F23Q 7/00* (2006.01)

(52) U.S. Cl. ..... 219/270; 219/260; 219/541

(58) Field of Classification Search ..... 219/270, 219/541, 267, 260; 123/145 A, 145 R; 361/264–266
See application file for complete search history.

(56) References Cited

U.S. PATENT DOCUMENTS

| | | | | |
|---|---|---|---|---|
| 3,372,305 | A | 3/1968 | Mikulec | |
| 3,806,308 | A | 4/1974 | Cahoe et al. | |
| 4,029,936 | A * | 6/1977 | Schweitzer | 219/267 |
| 4,475,029 | A | 10/1984 | Yoshida et al. | |
| 5,856,651 | A | 1/1999 | Shaffer | |
| 6,040,519 | A * | 3/2000 | Kita et al. | 136/230 |
| 6,130,410 | A * | 10/2000 | Kita | 219/270 |
| 2003/0080103 | A1 * | 5/2003 | Hamel et al. | 219/270 |
| 2004/0182145 | A1 * | 9/2004 | Okazaki et al. | 73/119 R |

* cited by examiner

*Primary Examiner*—Teresa J. Walberg
(74) *Attorney, Agent, or Firm*—McKenna Long & Aldridge LLP

(57) ABSTRACT

An igniter having an igniter element, a bushing, adhesive and sealant is provided. The igniter element has a polarizing key for generating heat at a high temperature. The bushing is inserted on an outside of one end of the igniter element. The adhesive is placed in a bushing cavity for bonding the bushing with the igniter element. The sealant covers both the bushing and the adhesive placed in the cavity of the bushing thereby joining the bushing and adhesive and improving joining structures of components.

88 Claims, 16 Drawing Sheets

IGNITER AND DRYER THEREWITH

This application claims the benefit of Korean Patent Application Nos. P2003-0002457 filed on Jan. 14, 2003, and P2003-0011051 filed on Feb. 21, 2003, all of which are hereby incorporated by reference for all purposes as if full set forth herein.

BACKGROUND OF THE INVENTION

1. Field of the Invention

The present invention relates to dryers, and more particularly, to a dryer having an improved igniter in a burner for generating heated air.

2. Background of the Related Art

In general, a dryer blows air heated by a heater into a drum for evaporating moisture from an object to be dried ("drying object") in the drum to dry the drying object. There are exhaust type dryers and condensing type dryers and the method for disposing humid air generated during drying of the drying object determine the type.

An exhaust type dryer discharges humid air generated in the drum during drying of the drying object to the outside the dryer. The exhaust type dryer also introduces new dry air into the dryer, heats the new dry air and blows the new dry air into the drum.

A condensing type dryer removes moisture in humid air generated when a drying object in a drum is dried with heated air. The condensing type dryer also heats air again, and blows the air into a drum.

Both the exhaust type and condensing type dryers use heated air for drying a drying object in a drum. A burner generates heated air in the dryer. In general, the burner has a gas pipeline connected thereto, and gas injected through an injection nozzle may be ignited with an igniter. The ignited flame heats the air introduced into the air, thereby generating the heated air.

In general, the igniter in the burner has a component assembly fixed to a fixing bracket, and a component assembly for generating heat, which may be fabricated separately, assembled together, and mounted on the burner.

When two component assemblies are thus assembled together, easy and firm joining of the components assemblies is required for enhancing productivity and reducing a defective proportion.

Moreover, rotation of the drum and the like cause vibration of the dryer. As such, a part to which the igniter of the burner fastens weakens from the vibration when the dryer is used for an extended period, thereby causing defective operation. Thus, it is required that the fastened part be durable enough to withstand weakening and breakage.

SUMMARY OF THE INVENTION

Accordingly, the present invention is directed to an igniter that substantially obviates one or more of the problems due to limitations and disadvantages of the related art.

An advantage of the present invention is to provide an igniter having an improved durability which can prevent separation or deformation of component assemblies in the igniter even if vibration is given thereto for a long time. Thus, the present invention prevents defective operation and an out of order condition.

Another advantage of the present invention is to improve ease of assembly during fabrication of the igniter.

A further advantage of the present invention is to provide a dryer in which malfunction or nonfunctioning condition of the burner is prevented as a durability of the igniter is improved.

Additional features and advantages of the invention will be set forth in the description which follows, and in part will be apparent to those having ordinary skill in the art upon examination of the following or may be learned from practice of the invention. The objectives and other advantages of the invention will be realized and attained by the structure particularly pointed out in the written description and claims hereof as well as the appended drawings.

To achieve these advantages and other advantages and in accordance with the purpose of the present invention, as embodied and broadly described herein, the igniter includes an igniter element having a polarizing key for generating heat at a high temperature. The igniter also has a bushing inserted on an outside of one end of the igniter element, adhesive placed in a cavity of the bushing for bonding the bushing with the one end of the igniter element, and sealant covering both the bushing and the adhesive placed in the cavity of the bushing for joining the bushing and adhesive.

In another aspect of the present invention, there is provided an igniter including an igniter element having a polarizing key for generating heat at a high temperature, a bushing inserted on an outside of an end of the igniter element, the bushing having means for preventing adhesive from moving along a length direction to increase a joining force with the adhesive, and adhesive placed in a cavity of the bushing for bonding the bushing with the one end of the igniter element.

In a further aspect of the present invention, there is provided an igniter including an igniter element having a polarizing key for generating heat at a high temperature and a bushing inserted on an outside of one end of the igniter element. The igniter also includes adhesive placed in a cavity of the bushing for bonding the bushing with the one end of the igniter element, and means for preventing the igniter element from moving in a length direction with respect to the bushing.

In a still further aspect of the present invention, there is provided a dryer including a cabinet, a drum rotatably mounted in the cabinet for holding a drying object, and a burner inside of the cabinet for generating heated air, including an igniter for igniting fuel supplied from an exterior. The igniter also includes an igniter element having a polarizing key for generating heat at a high temperature, a bushing inserted on an outside of one end of the igniter element, adhesive placed in a cavity of the bushing for bonding the bushing with the one end of the igniter element, and sealant covering both the bushing and the adhesive placed in the cavity of the bushing for joining the bushing and adhesive.

The igniter element includes a cylindrical hollow first body having straight slots extending in a length direction, and a second body extending in a length direction from the first body part where the second body has helical bands formed along a length direction of the second body starting from the slots. The igniter element also includes a polarizing key inserted in the first and second bodies, the polarizing key has a lead line connected thereto. The first and second bodies are formed of non-metallic resistant material, such as silicon carbide.

The polarizing key includes a large width part of a plate in the first body having a part exposed to an exterior through the slots, and a small width part in the second body extending from the large width part.

The igniter may further include a bracket fastened to an outside surface of the bushing.

The sealant may be selected from silicone, epoxy, and EMC (Epoxy Molding Compound). The adhesive may also be ceramic cement.

The sealant is coated on a side of the bushing opposite to a side which contacts the igniter element thereby covering both the adhesive and the bushing. The sealant is coated on a side of the bushing the igniter element in order to cover both the bushing and an area of an outside circumferential surface of the igniter element. The adhesive may be placed in part of the cavity of the bushing, and the sealant is placed in a remainder of the cavity. Alternatively, the adhesive may be placed in substantially one half of the cavity, and the sealant may be placed in a remainder of the cavity.

The means provided to the bushing for preventing the adhesive from moving in a length direction of the bushing may be an uneven surface formed in an inside circumferential surface of the bushing. The uneven surface may be a dimple, or a lattice. In addition, the means may be a flange extending inward from the bushing. The flange may be formed at a side of the bushing opposite to a side of the bushing which contacts the igniter element.

The means for preventing the adhesive from moving in a length direction with respect to the bushing may include key slots in an outside surface of the polarizing key, and a snap ring inserted on an outside circumference of the igniter element so as to be inserted in the key slots in contact with the bushing thereby preventing the igniter element from moving toward the bushing. The snap ring may be formed of a non-metallic material.

The means for preventing the adhesive from moving in a length direction with respect to the bushing may include a stopper flange on the bushing which projects inward from a side of the bushing which contacts the igniter, guide slots in the stopper flange which guide opposite side surfaces of the polarizing key when the bushing is inserted in the igniter element, and bushing stopper slots which receive the stopper flange to limit a length direction movement of the bushing and the igniter element when the bushing is turned after the igniter element is inserted in the bushing.

The means for preventing the adhesive from moving in a length direction with respect to the bushing may further include a stopper projection for limiting a rotation angle of the bushing when the bushing is rotated as the stopper flange is inserted in the bushing stopper slots. The means may include a female thread formed in an outside circumferential surface of the polarizing key, and a male thread on an inside circumferential surface of the bushing for engaging with the female thread in the polarizing key.

The means for preventing the adhesive from moving in a length direction with respect to the bushing may include a step on an inside circumferential surface of the bushing, and a step on an outside circumferential surface of the polarizing key so as to be engaged with the step on the bushing for preventing the igniter element from moving in any length direction.

The bushing is fastened to the igniter element as the bushing is inserted from a fore end of the igniter element to a rear end of the igniter element to which a lead line is connected. The step on the bushing is formed at a boundary surface between a small diameter part formed on an inside circumferential surface of the bushing at a side of the bushing at a rear end of the igniter element that is in direct contact with the bushing, and a large diameter part formed on the inside circumferential surface of the bushing so as to be in contact with the small diameter part. The step on the polarizing key is formed at a boundary surface between a first large width part in contact with the small diameter part at the rear end side of the igniter element and a second large width part on the outside circumferential surface of the polarizing key so as to be in contact with the large diameter part.

The bushing is inserted from a rear end of the igniter element to a fore end of the igniter element. The step on the bushing is formed at a boundary surface between a large diameter part formed on an inside circumferential surface of the bushing at a side of the bushing which is in direct contact with a rear end of the igniter element, and a small diameter part formed on the inside circumferential surface of the bushing so as to be in contact with the small diameter part. The step on the polarizing key is formed at a boundary surface between a second large width part in contact with the large diameter part at rear end side of the igniter element and the first large width part on the outside circumferential surface of the polarizing key so as to be in contact with the small diameter part.

It is to be understood that both the foregoing description and the following detailed description of the present invention are exemplary and explanatory and are intended to provide further explanation of the claimed invention.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings:

FIGS. 4A–4D illustrate the steps of a method for fabricating the igniter in FIG. 3, wherein FIG. 4A illustrates a front view of a bushing having a bracket fastened thereto prior to insertion in an igniter element;

FIG. 4B illustrates a front view showing a state after assembly of FIG. 4A;

FIG. 4C illustrates a section of FIG. 4B;

FIG. 4D illustrates an inside of a bushing filled with adhesive; and

DETAILED DESCRIPTION OF THE ILLUSTRATED EMBODIMENTS

Reference will now be made in detail to the embodiments of the present invention, examples of which are illustrated in the accompanying drawings. In describing the embodiments, same parts will be given the same names and reference symbols, and repetitive description will be omitted.

Figure 1:
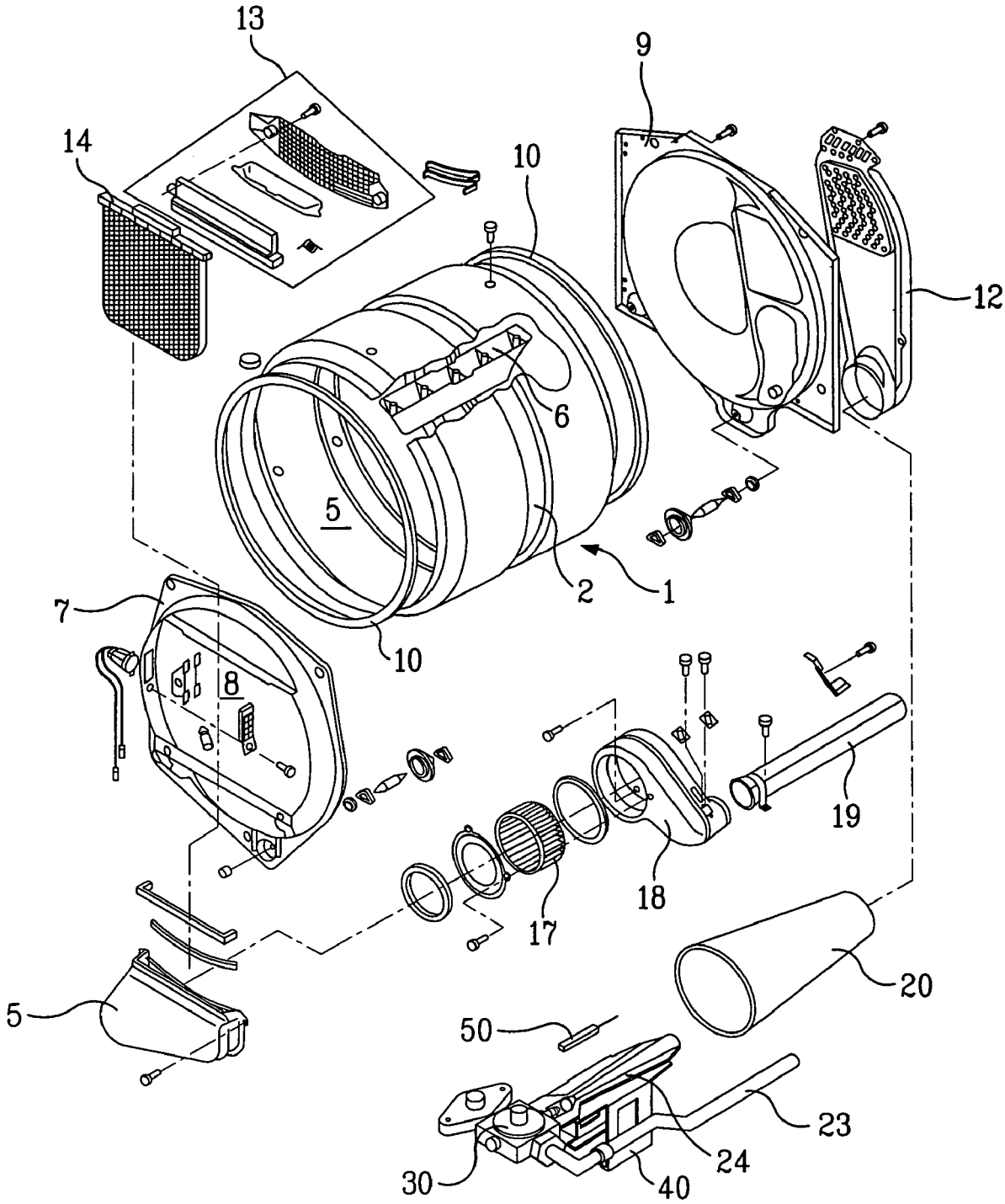
FIG. 1 illustrates a disassembled perspective view of a dryer in accordance with a preferred embodiment of the present invention.
Figure 2:
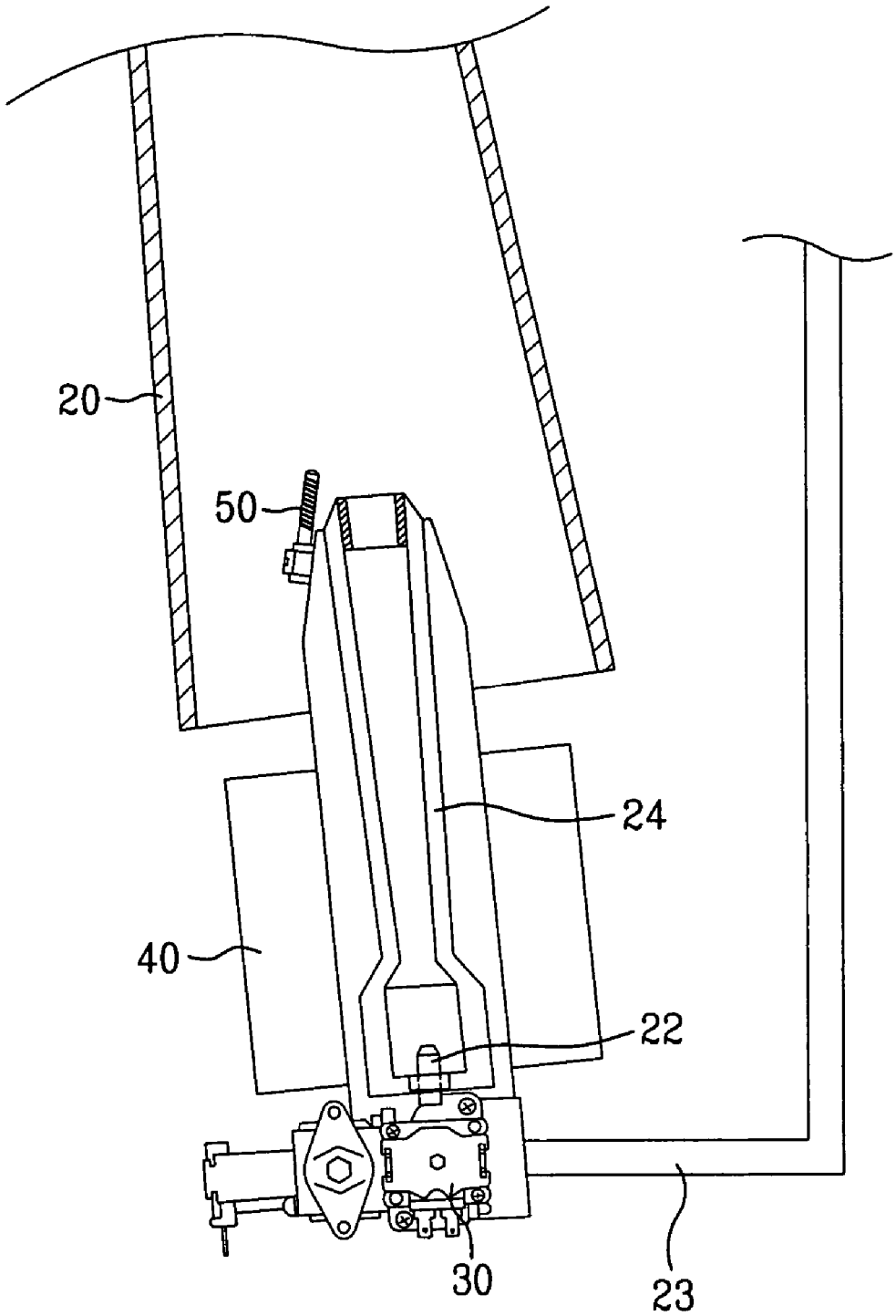
FIG. 2 illustrates a plan view of a structure of the burner in FIG. 1.

FIG. 1 illustrates a disassembled perspective view showing a dryer in accordance with a first embodiment of the present invention, and FIG. 2 illustrates a plan view showing a structure of the burner in FIG. 1.

Referring to FIGS. 1 and 2, there is a drum 1 rotatably mounted inside of a cabinet 100 that forms an outer appearance of the dryer. The drum 1, which is cylindrical overall, includes opened front and rear parts, and a belt groove 2 formed along an outside circumferential surface for winding a belt (not shown) thereon driven by a separate driving source, for example, a motor.

The drum 1 has a drying chamber 5 formed therein, with a plurality of lifts 6 for lifting up and dropping down a drying object in the drying chamber 5 to improve a drying efficiency by turning the drying object upside down.

The dryer also includes a front panel 7 and a rear panel 9 each located at a fore end and a rear end of the drum, oppositely. The front panel 7 and the rear panel 9 close a front and a rear of the drum 1 to form the drying chamber 5.

Additionally, the dryer has sealers 10 between the front panel 7 and the rotating drum 1, and the rear panel 9 and the rotating drum 1, for preventing leakage.

A plurality of rollers (not shown) are on the front panel 7 and the rear panel 9 for supporting opposite front and rear parts of the drum 1.

The dryer also has an opening 8 in the front panel 7 for allowing communication between the drying chamber 5 and an exterior. The opening 8 is opened/closed by a door (not shown).

A heated air supplying duct 12 mounts on the rear panel 9 in communication with the drying chamber 5 which serves as a passage for supplying heated air to the drying chamber 5.

An air exhaust grill assembly 13 disposed in a lower part of the opening 8 in the front panel 7 allows for the escaping of air from the drying chamber 5.

A lint filter 14 mounts together with the air exhaust grill assembly 13. The lint filter 14 filters foreign matter (for example, waste thread, or dust) mixed with the air escaping from the drying chamber 5.

A lint duct 15 communicates with the air exhaust grill assembly 13, and the lint filter 14 extends into the lint duct 15. A blower 17 connects to the lint duct 15 for drawing out air from the drying chamber 5 through the lint duct 15. The blower 17 is provided inside a blower housing 18.

The blower housing 18 has one side in communication with the lint duct 15 and the other side connects to an exhaust pipe 19. Therefore, air escaping from the drying chamber 5 and passing through the lint duct 15 discharges to an exterior through the exhaust pipe 19 by blowing action of the blower 17.

Furthermore, a guide funnel 20 connects to an inlet of the heated air supplying duct 12. The guide funnel 20 guides heated air, generated as gas burns, toward the inlet of the heated air supplying duct 12.

A mixing pipe 24 positioned at an inlet of the guide funnel 20 mixes gas injected from a gas nozzle 22 and primary air.

The mixing pipe 24 is fixed to a top surface of a burner support 40 which is fixed to a floor of the cabinet. An igniter 50 fastens to one side of the burner support 40 with fastening members, such as screws, for igniting the mixed gas from the mixing pipe 24.

The burner support 40 has a front side higher than a rear side to form a slope which positions an outlet side of the mixing pipe 24 fixed to an upper surface of the burner support 40 higher than an inlet side thereof. As such, an axis direction of the mixing pipe is the same as a direction of a flame advance.

Referring to FIG. 2, the outlet of the mixing tube 24 is positioned a distance inside of the guide funnel 20 from the inlet of the guide funnel 20.

The gas nozzle 22 is correspondingly mounted in the inlet of the mixing tube 24. The gas nozzle 22 has a valve 30 for supplying and controlling a supply rate of gas.

A gas pipe 23 connects to the valve 30 for continuously supplying gas from a separate gas source.

Accordingly, gas injected from the gas nozzle 22 and external air, primary air, from the inlet of the mixing pipe 24 are mixed inside the mixing tube 24.

The drying operation of the dryer will be described.

After introducing a drying object (for an example, wet laundry) into the drying chamber 5 in the drum 1 and closing the door, an operation button is pressed for operating the dryer. When operation begins, the belt around the belt groove 2 is driven by another driving source thereby rotating the drum 1.

As the blower 17 begins operation, air is drawn from the drying chamber 5 through the lint duct 15.

Then, external air is introduced into the drying chamber 5 through the heated air supplying duct 12 due to a pressure difference. In this instance, the air supplied to the heated air supplying duct 12 is heated by the gas burning device and has a relatively high temperature.

To further illustrate, gas is injected into the mixing pipe 24 through the gas nozzle 22, and the primary air is introduced into the inlet of the mixing pipe 24. The gas and the primary air are mixed inside the mixing pipe 24, ignited by a heated igniter 50 at the outlet of the mixing tube 24, and burned. A thermal energy generated as the gas burns thus is introduced into the guide funnel 20 and heats the air to generate the heated air.

The heated air is then introduced into the drying chamber 5 in the drum 1 through the heated air supplying duct 12.

After absorbing moisture from laundry in the drying chamber 5, the heated air escapes from the drying chamber 5 through the air discharge grill assembly 13 by a suction force of the blower 17.

Foreign matters, such as dust and waste thread in the air passing through the air discharge grill assembly 13, are filtered as the air passes through the lint filter 14.

Figure 3:
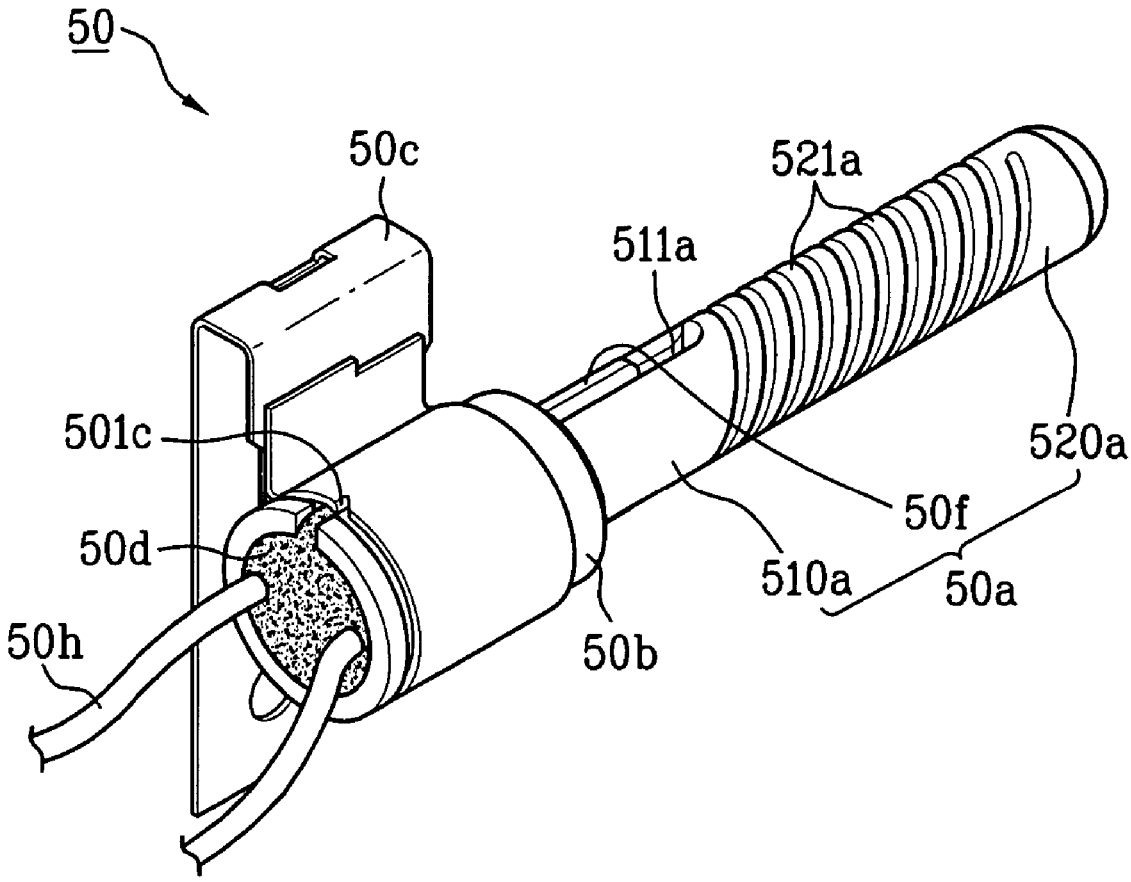
FIG. 3 illustrates a perspective view of a structure of the igniter in FIG. 2.

An igniter applicable to the dryer of the present invention and a method for fabricating the same will be described in detail with reference to FIGS. 3 and 4.

The igniter element 50*a* is formed of a non-metallic resistant material, such as silicon carbide SiC, and includes first and second bodies 510*a* and 520*a* of hollow cylinders, and a polarizing key 50*f*.

The first body 510*a* has two straight slots 511*a* formed in an outside circumferential surface, and the second body 520*a* extends in a length direction from the first body 510*a*. The slots 511*a* are formed in opposite sides of the first body 510*a*. The second body 520*a* has helical bands 521*a* formed along a length direction of the second body 520*a* starting from the two slots 511*a*. A coat of nickel is on an outside circumference of the first body 510*a* of the igniter element 50*a* for improving conductivity.

Referring to FIGS. 4A–4D, the polarizing key 50*f* is positioned inside of the first and second bodies 510*a* and 520*a*, and a portion of which is exposed through the slots 511*a* in the first body 510*a*. A lead line 50*h* is connected to the polarizing key 50*f*. The polarizing key 50*f* is heated to a high temperature when power is provided thereto through the lead line 50*h*.

A bushing 50*b* is inserted to an outside of the first body part 510*a*. A bracket 50*c* is fixed to an outside circumference to the bushing 50*b*, and the bracket 50*c* is fastened to the burner support 40. A wedge piece 501*c* is positioned inside the bushing 50*b* through a notch in the bushing 50*b* at one side of the bracket 50*c*. Adhesive 50*d* is filled inside of the bushing 50*b* for fixing the bushing 50*b* to the first body 510*a* of the igniter element 50*a*.

A method for fabricating the igniter 50 will now be described.

Figure 4A:
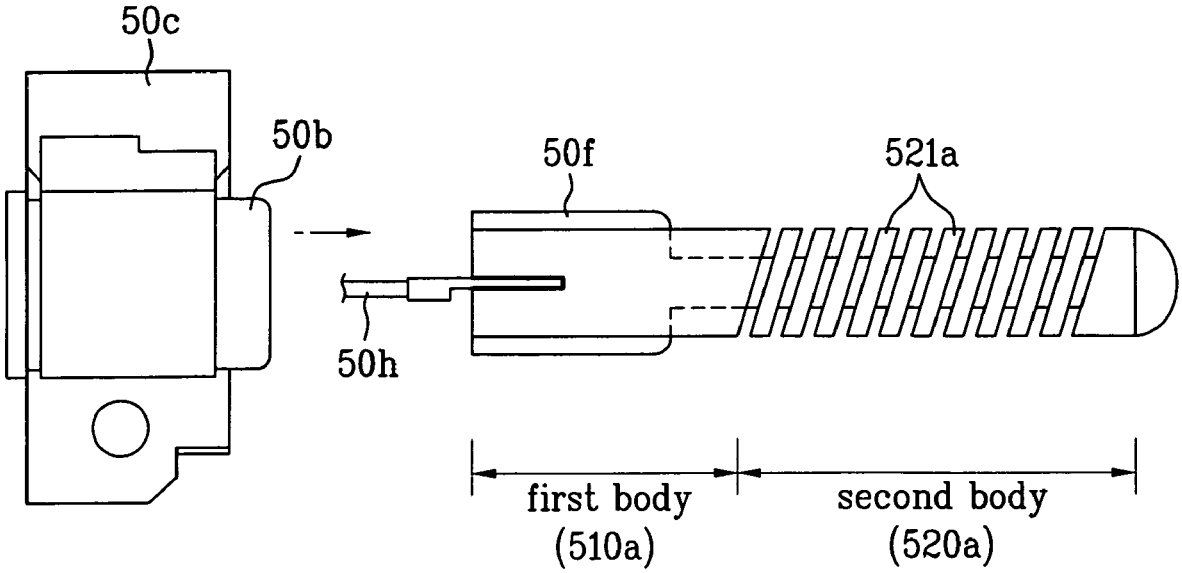
Figure 4B:
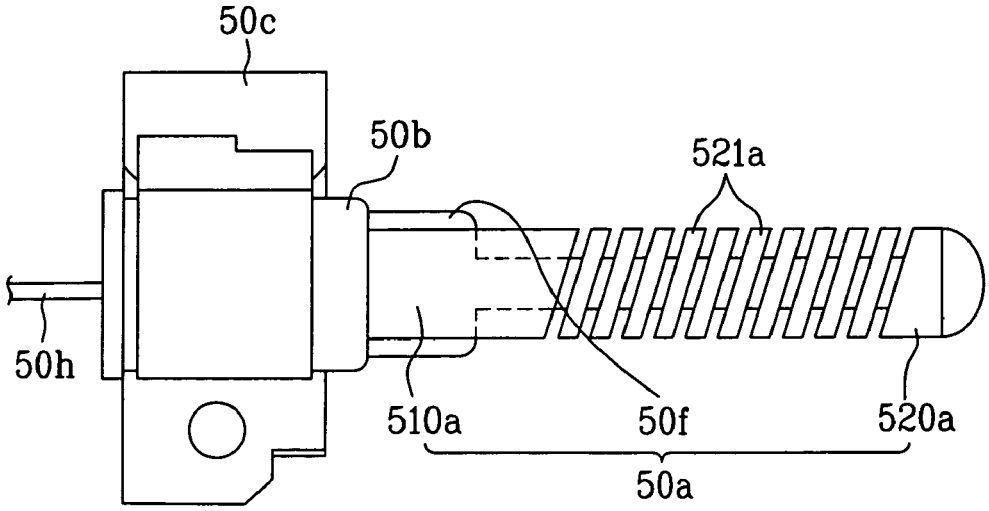

Referring to FIG. 4A, an igniter element 50*a* having a polarizing key 50*f* provided inside of the first and second bodies 510*a* and 520*a* is provided. Additionally, the bushing 50*b* is fastened to the bracket 50*c*. Then, as shown in FIG. 4B, the lead line 50*h* is put through an inside of the bushing 50*b*, and the bushing 50*b*, having the bracket 50*c* fastened thereto, is inserted to a rear end of the igniter element 50*a*.

Figure 4C:
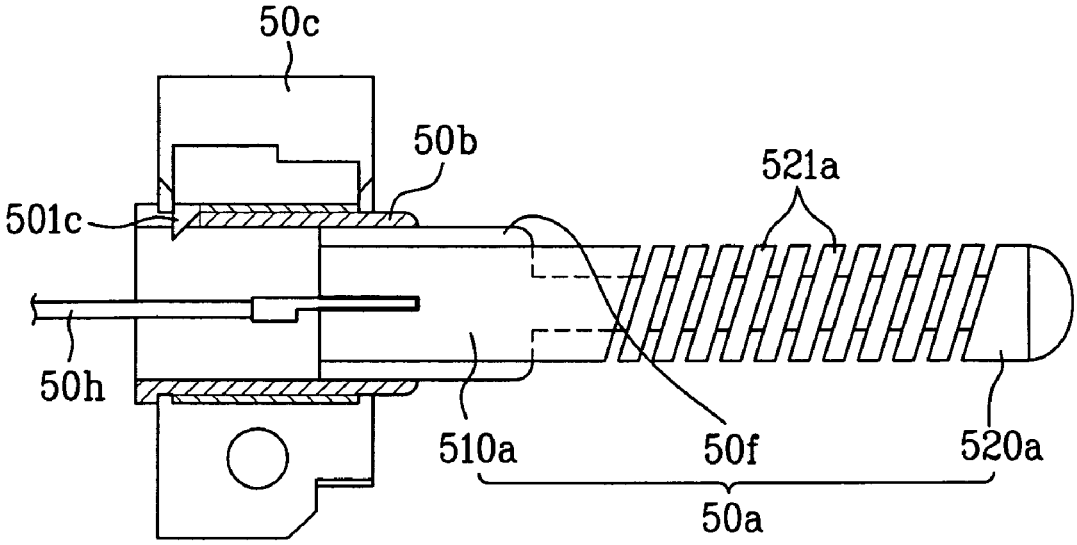

In this state, as shown in a front sectional view of FIG. 4C, the bushing 50*b* has a cavity.

Figure 4D:
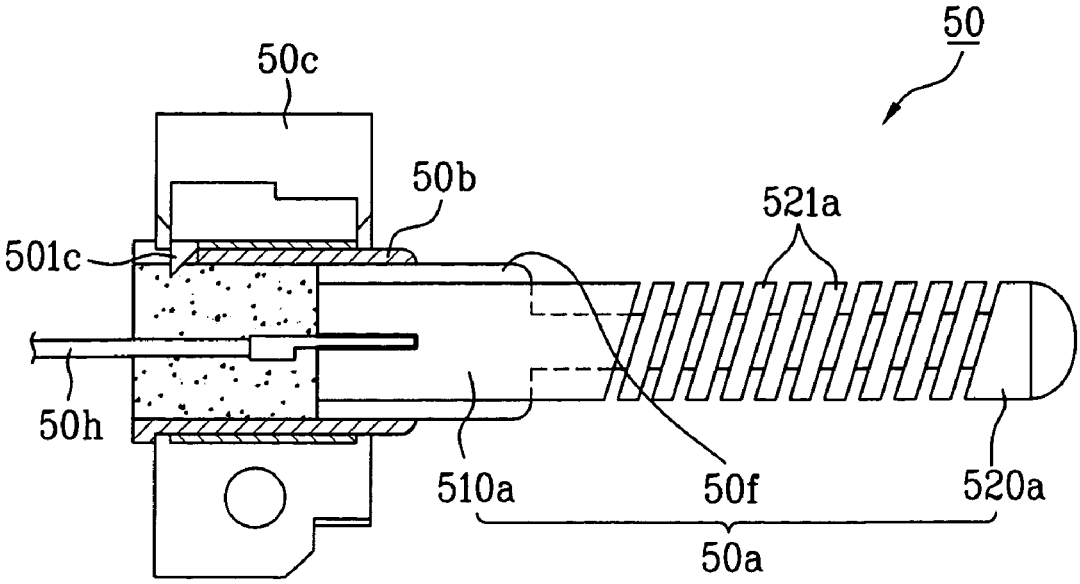

Next, when the bushing 50*b* is set in a position on the igniter element 50*a*, a paste of an adhesive 50*d* is placed into the bushing 50*b* through a first body 510*a* side of the igniter element 50*a* (i.e., a rear end side) (see FIG. 4D).

Then, as the adhesive 50*d* sets, the wedge piece 501*c*, which is formed as one side of the bracket 50*c* is cut and bent inward so as to be positioned inside of the bushing 50*b* through a notch in the bushing 50*b*, is buried and fixed. As such, the bushing 50*b* is fixed to the bracket 50*c* and the bushing 50*b* maintains a joined state with the igniter element 50*a*.

When the adhesive 50*d* is placed in the bushing 50*b*, the bushing 50*b* is placed into an oven (not shown) for joining the bracket 50*c* and the adhesive 50*d* by setting the adhesive 50*d* with the wedge piece 501*c* which is buried therein.

Then, a terminal block (not shown) is joined at an end of the lead line 50*h*.

Figure 4E:
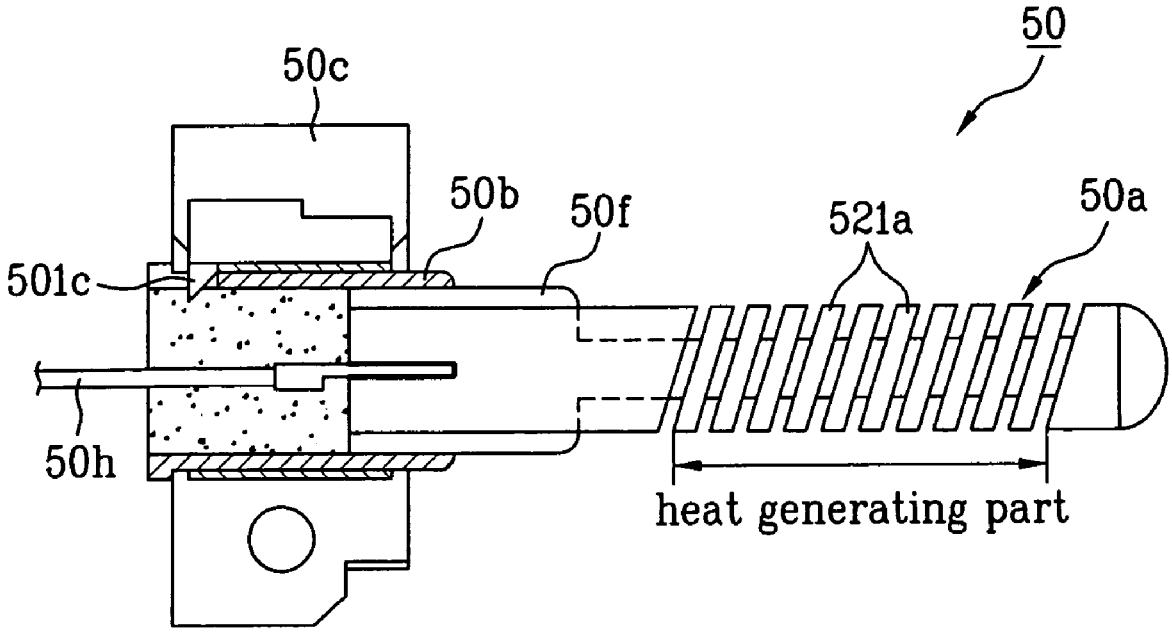
FIG. 4E illustrates a section of a heat generating part of an igniter.
Figure 5A:
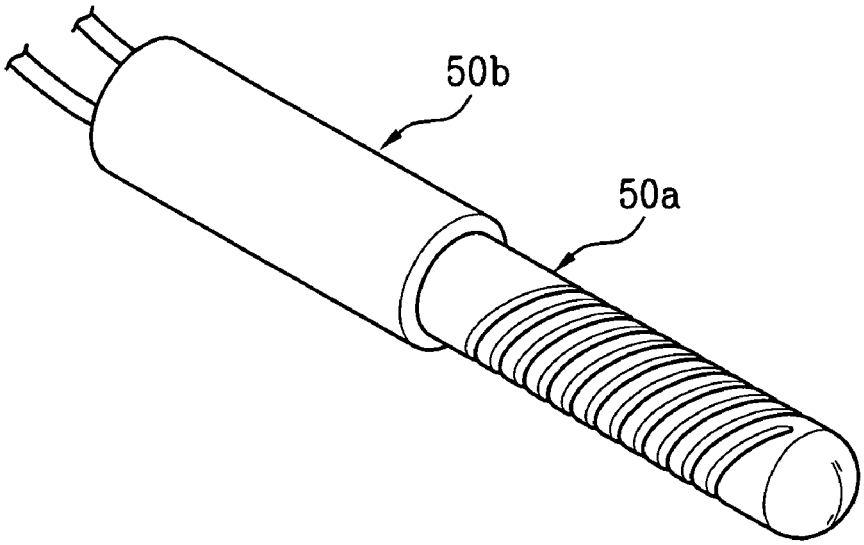
FIGS. 5A–5D illustrate front views and perspective views of examples of igniters.
Figure 5B:
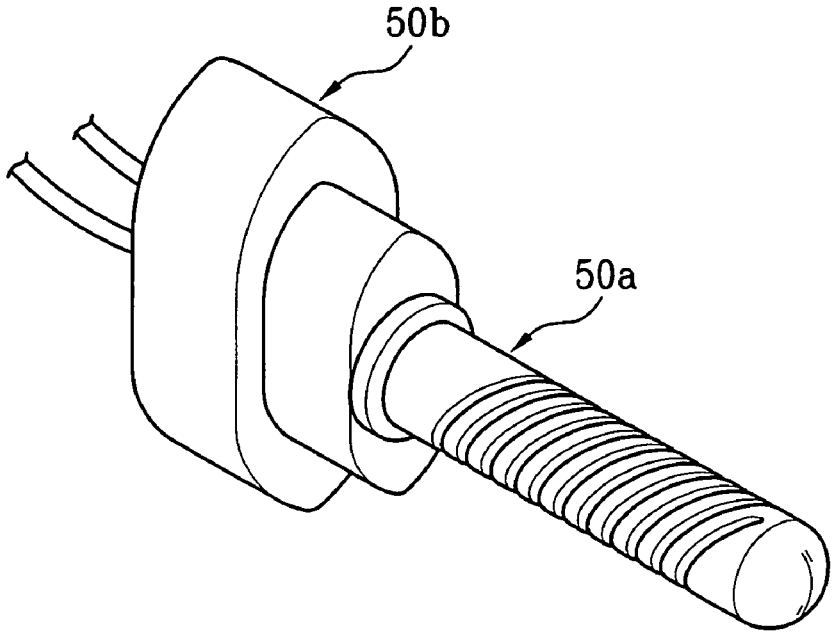
Figure 5C:
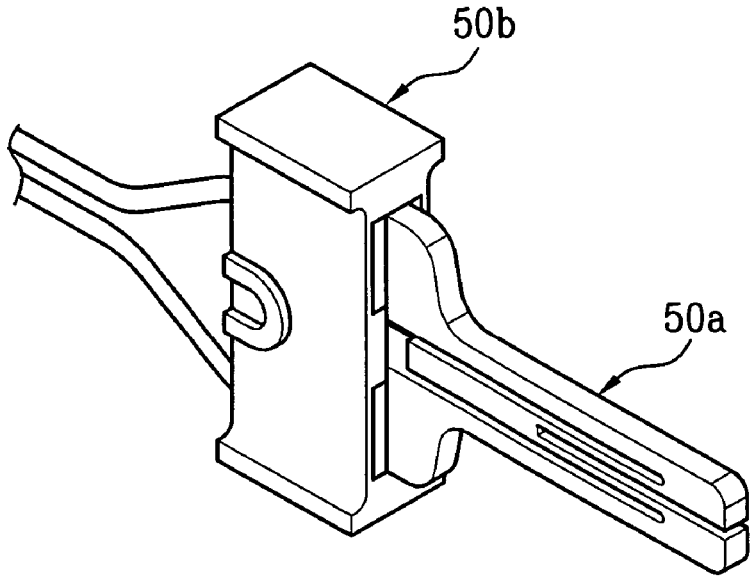
Figure 5D:
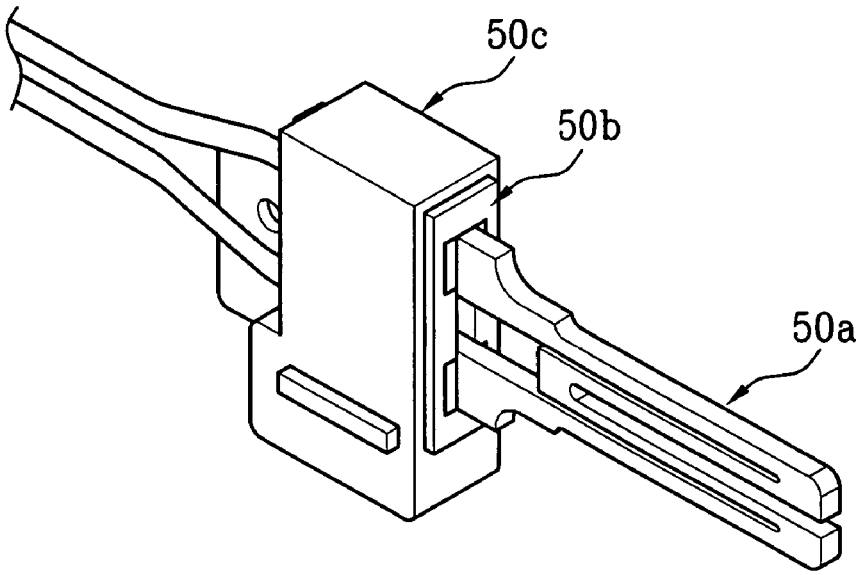

Referring to FIG. 4E, when the igniter 50 is provided with power, the polarizing key 50*f* in the helical band 521*a* is heated to a high temperature.

However, the foregoing igniter and a dryer have the following problems.

During fabrication of the igniter 50, before inserting the bushing 50*b* having the bracket 50*c* fastened thereto to the outside circumference of the igniter element 50*a*, and placing the adhesive 50*d* in an inside of the bushing 50*b*, positioning of the bushing 50*b* on the igniter element 50*a* may be required, for which an additional jig (not shown) is required.

Without the additional jig, positioning of the bushing 50*b* on the igniter element 50*a* may not be possible, thus, the position of the bushing changes along a length direction of the igniter element 50*a*, causing difficulty in placeing the adhesive 50*d*, and resulting in difficulty in progressing a process for joining the bushing 50*b* and the igniter element 50*a*. Since the jig is required for solving the difficulty, production costs rise, and the fabrication process becomes complicated.

Particularly, in addition to the problems in fabrication of the igniter 50, the igniter causes the following problems when the igniter is applied to products, such as dryer, and the like.

System vibration, which occurs as the drum driving motor or blower is driven, is transmitted to the burner support 40, and the vibration of the burner support 40 is in turn transmitted to the igniter 50 fastened thereto, causing vibration of the igniter 50.

Although the bushing 50*b* of the igniter 50 is fastened to the bracket firmly, the adhesive 50*d* in the bushing 50*b* is sensitive to an impact, such that a holding force of the adhesive 50*d* to the wedge piece 501*c* drops gradually due to the vibration.

The vibration of the bracket 50*c* caused by the system vibration makes the wedge piece 501*c* of metal buried in the adhesive 50*d* wear down or damage a part of the adhesive in contact with the wedge piece 501*c*, thereby loosening the joined state of the bracket 50*c* and the adhesive 50*d*.

When the bushing 50*b* loosens fully from the adhesive 50*d* as the system vibration is repeated, the igniter element 50*a* bonded with the adhesive 50*d* displaces relative to the bushing 50*b*.

Particularly, as described before, since the front side of the burner support 40 is higher than the rear side, such that the mixing pipe fixed to the upper surface of the burner support 40 and the igniter 50 fastened to the burner support 40 are sloped, the igniter element 50*a* gradually slips backward with respect to the bushing 50*b*, and breaks away from a proper position.

Thus, when a bonding force between the bushing 50*b* and the adhesive 50*d* in the igniter 50 drops due to system vibration, a relative displacement of the igniter element 50*a* with respect to the bushing 50*b* takes place, resulting in break away of the igniter element 50*a* from a proper position of the inlet of the mixing pipe, thereby causing ignition failure during starting of the dryer.

Moreover, the igniters in FIGS. 5A–5D have the problem related to break away of the bushing 50*b* and the igniter element.

Even though the igniter may not be a type where the bracket 50*c* is fixed to the bushing 50*b*, when vibration is transmitted to the bushing 50*b* continuously where the igniter 50 is fixed to a system by additional means, the bonding force between the bushing 50*b* and the igniter 50*a* drops.

Accordingly, the present invention provides an igniter having an improved structure that can solve the foregoing problem. The embodiments will be described with reference to the attached drawings in detail. In describing the embodiments, parts the same as the foregoing parts will be given the same names and reference symbols.

Figure 6:
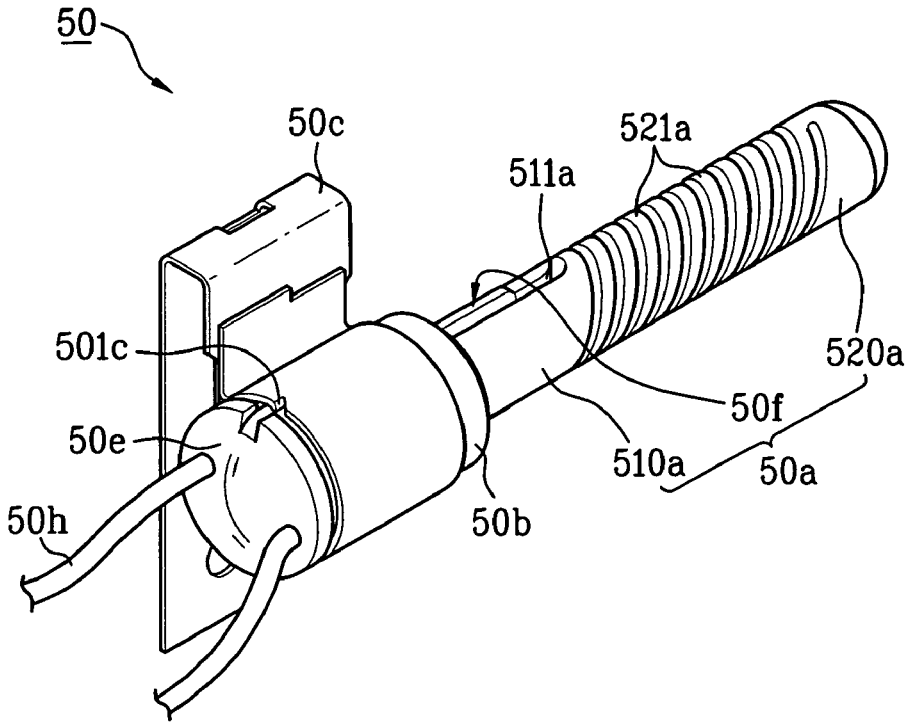
FIG. 6 illustrates a perspective view of an improved igniter in accordance with a first preferred embodiment of the present invention.
Figure 7:
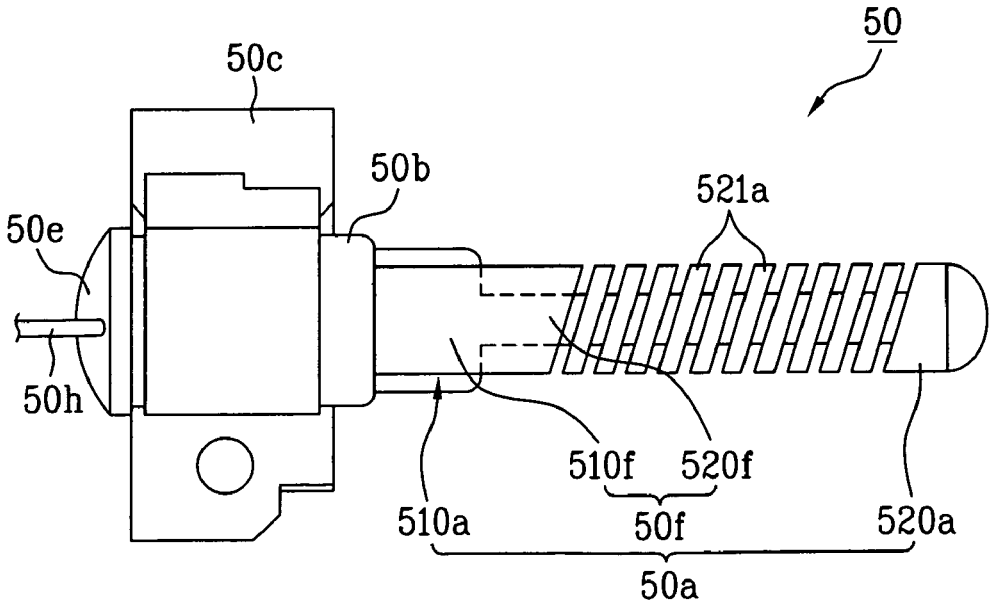
FIG. 7 illustrates a front view of FIG. 6.

FIG. 6 illustrates a perspective view of an improved igniter in accordance with a first embodiment of the present invention, and FIG. 7 illustrates a front view of FIG. 6, the igniter 50 in accordance with the first embodiment of the present invention will now be described.

The igniter element 50*a* includes first and second bodies 510*a* and 520*a*, and a polarizing key 50*f*.

The first or second bodies 510*a* and 520*a* is long and hollow, and formed of non-metallic resistant material, such as silicon carbide. As shown in FIG. 6, there are straight slots 511*a* in opposite sides of an outside surface of the first body 510*a*. Also as shown in FIG. 6, the second body 520*a* extends from the first body 510*a* in a length direction. The second body 520*a* has helical bands 521*a* extending in a helical form along the length direction of the second body 520*a* starting from the slots 511*a*. A coat of nickel is applied to an outside circumference of the first body 510*a* of the igniter element 50*a* for improving conductivity.

The polarizing key 50*f*, which may be a plate form, is positioned inside the first and second bodies 510*a* and 520*a*, and, as shown in FIG. 6, a portion of the polarizing key 50*f* is exposed through the slots 511*a* in the first body 510*a*.

The polarizing key 50*f* has a large width part 510*f* and a small width part 520*f*. As shown in FIG. 7, both sides of the large width part 510 are exposed to the exterior through the slots 511*a* in the first body 510*a*. Also as shown in FIG. 7, the small width part 520*f* extends from the large width part 510*f* into an inside of the helical bands 521*a* of the second body 520*a*.

A lead line 50*h* connects to the polarizing key 50*f*. The small width part 520*f* inside of the helical bands 521*a* heats to a high temperature when a power is provided to the polarizing key 50*f* through the lead line 50*h*.

Referring to FIG. 6, a bushing 50*b* is placed over a portion of the first body part 510*a* of the igniter element 50*a*. A bracket 50*c* is fixed to an outside circumference of the bushing 50*b*, and the bracket 50*c* is fastened to a fastening part, such as a burner support 40. At one side of the bracket 50*c*, there is a wedge piece 501*c* positioned inside the bushing 50*b* through a notch in the bushing 50*b*. Additionally, adhesive 50*d* (not shown) is placed inside of the bushing 50*b* for bonding the bushing 50*b* to the first body 510*a* of the igniter element 50*a*. The adhesive may be a ceramic cement having a strong insulating strength.

Sealant 50*e* is coated on and covers both the adhesive and the bushing 50*b* opposite to a side of the bushing 50*b* which is in contact with the first body 510*a* in which the adhesive is injected therethrough. Examples of the sealant 50*e* which may be used include silicone or epoxy resin, EMC (Epoxy Molding Compound), or the like. The sealant 50*e* is not limited thereto, as any material having a bonding force and heat resistance may be used.

The action of the igniter 50 in accordance with a first embodiment of the present invention will be described when the igniter 50 is applied to a product, such as a dryer.

During operation of a dryer, system vibration, which takes place as the drum driving motor or blower is driven, is transmitted to the burner support 40, and the vibration of the burner support 40 is in turn transmitted to the igniter 50 fastened thereto, making the igniter 50 vibrate.

The firm fastening of the bushing 50*b* to the bracket 50*c* and the bonding of the bushing 50*b* with the adhesive with sealant 50*e*, such as silicone, which maintains a fastened state, does not allow the vibration to affect the bonding force between the bushing 50*b* and the adhesive 50*d* even if the vibration is transmitted to the bracket 50*c*.

If the system vibration is transmitted to the bracket 50*c*, the bonding force between the bushing 50*b* and the adhesive 50*d* is not reduced by a gripping force of the sealant 50*e*, thereby preventing the igniter element 50*a* from falling off the adhesive 50*d*.

As described before with reference to FIGS. 1 and 2, since the front side of the burner support 40 is higher than the rear side such that the mixing pipe fixed to the upper surface of the burner support 40 and the igniter 50 are sloped, it is possible that the igniter element 50*a* may gradually slip backward with respect to the bushing 50*b* and break away from a proper position. The sealant 50*e* is coated on a side of the bushing 50*b* on which the adhesive is injected therethrough, thus gripping the adhesive and the bushing at the same time. As such, break away of the igniter element 50*a* is prevented.

Other embodiments of the present invention will be described in succession. In describing the embodiment, description of parts which are the same as those discussed with reference to the first embodiment will be omitted.

Figure 8:
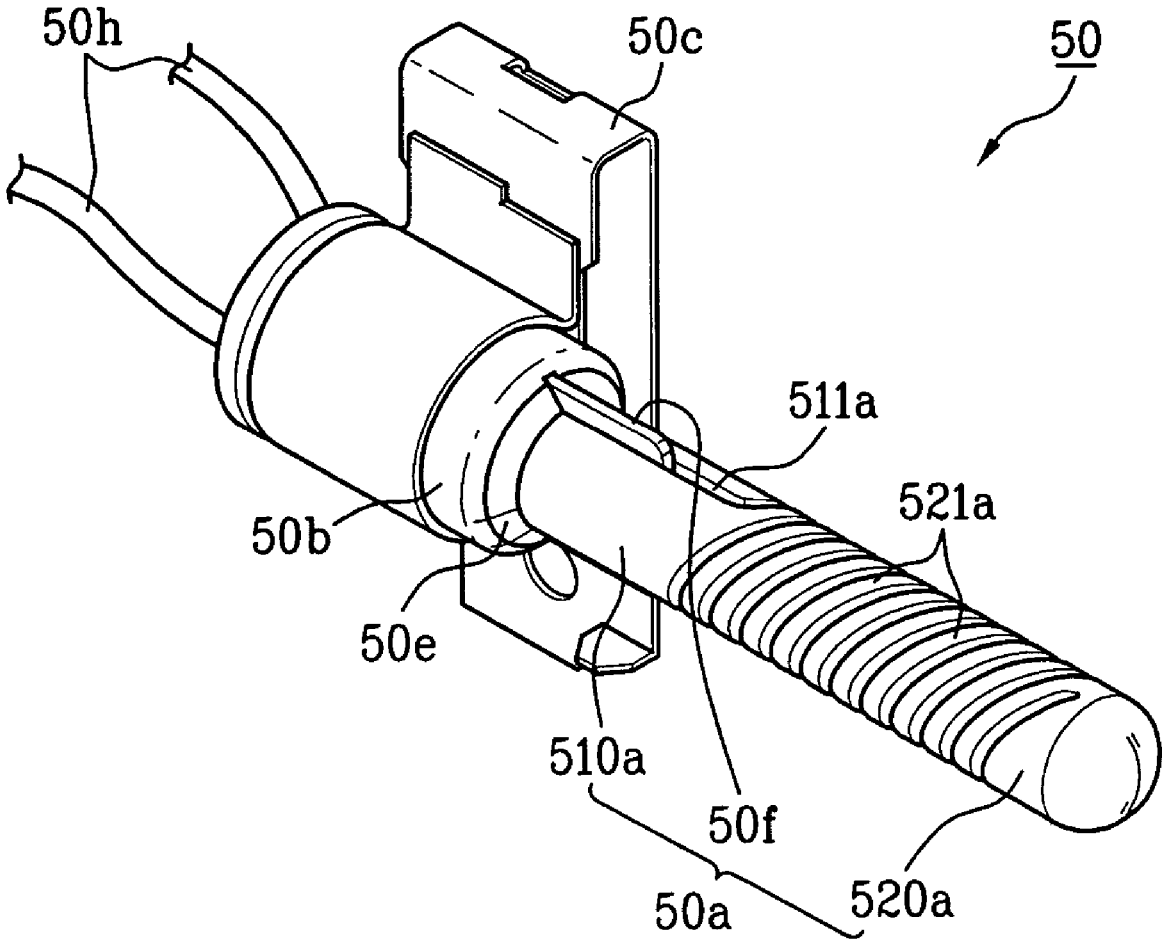
FIG. 8 illustrates a perspective view of an improved igniter in accordance with a second embodiment of the present invention.

FIG. 8 illustrates a perspective view of an improved igniter 50 in accordance with a second embodiment of the present invention having a system such as the embodiment described with reference to FIGS. 6 and 7. As shown in FIG. 8, the sealant 50*e*, such as silicone or the like, is coated on a side of the bushing 50*b* opposite to a side of the bushing 50*b* where adhesive is injected therethrough, i.e., on a side in direct contact with the first body 510*a*. The sealant 50*e* covers both the bushing 50*b* and a part of an outside circumferential surface of the igniter element 50*a*.

According to the second embodiment of the present invention, as the sealant 50*e* is coated on a side of the bushing 50*b* opposite the side the adhesive is injected therethrough, the sealant 50*e* grips the adhesive 50*d* and the bushing 50*b* at the same time. Thus, break away of the igniter element 50*a* can be effectively prevented when vibration of the system is transmitted to the igniter 50.

Moreover, if the igniter 50 is mounted horizontally, or the front of the igniter (a side of the second body) is lower than a rear side of the igniter (a side of the first body), the break away of the igniter element 50*a* is prevented.

Figure 9:
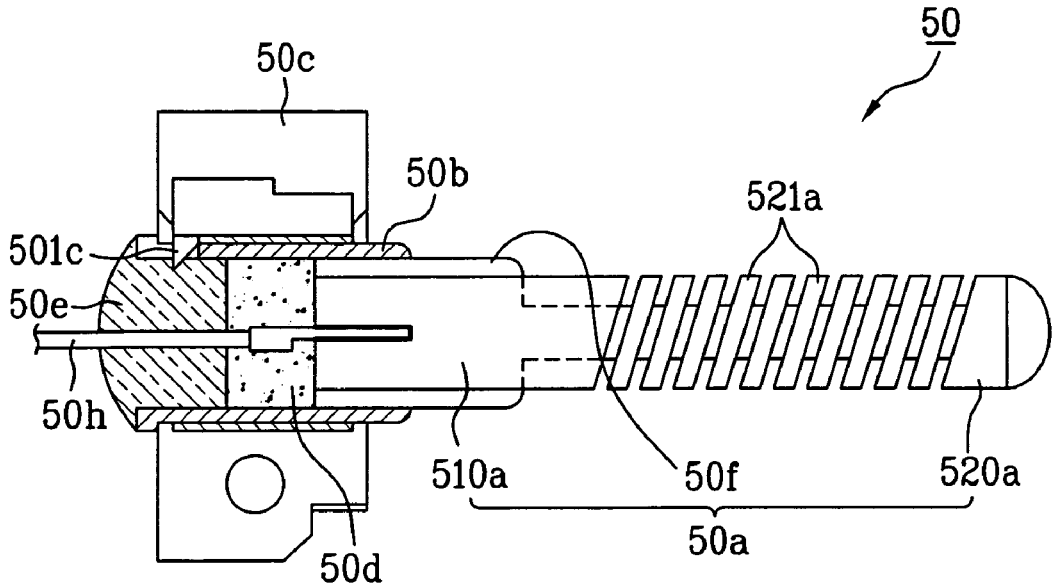
FIG. 9 illustrates a front view of an improved igniter in accordance with a third embodiment of the present invention.

FIG. 9 illustrates a front view, of an improved igniter in accordance with a third embodiment of the present invention.

The igniter 50 in accordance with the third embodiment of the present invention includes adhesive 50*d* placed in a portion of a cavity of the bushing 50*b*, and sealant 50*e*, such as silicone, placed in a remainder of the cavity.

In an embodiment, the adhesive 50*d* is placed substantially in one half of the cavity of the bushing 50*b*, and the sealant 50*e* is placed in a remainder of the cavity.

In this case, the joining force between the bushing 50*b* and the adhesive 50*d* becomes greater due to a bonding force of the sealant following an increase of the sealant 50*e*. Therefore, this embodiment more effectively prevents break away of the igniter element 50*a* if the front side of the igniter 50 is higher than the rear side.

Furthermore, as will be discussed in greater detail later on, changing a structure of the bushing of an igniter, or changing both the structures of the bushing and the polarizing key of an igniter, the igniter (see FIGS. 10–14) provides a structure that prevents break away of components of the igniter without using the sealant 50*e*.

Figure 10:
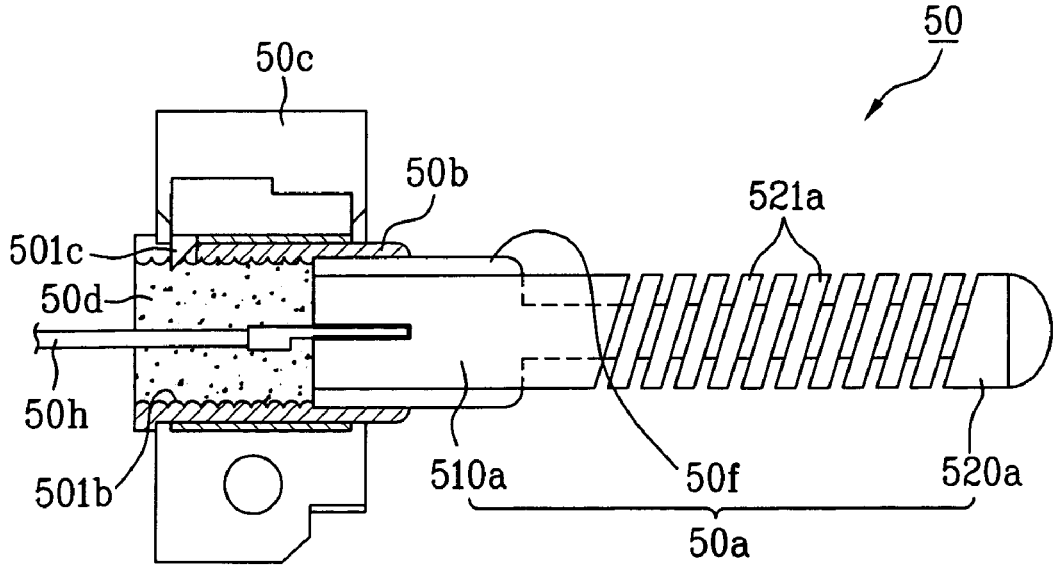
FIG. 10 illustrates a front view of an improved igniter in accordance with a fourth embodiment of the present invention.

FIG. 10 illustrates a front view of an improved igniter in accordance with a fourth embodiment of the present invention. As shown in FIG. 10, the igniter 50 includes an uneven surface 501*b* along an axis direction of an inside circumferential surface of the bushing 50*b*.

Referring to FIG. 10, the uneven surface 501*b* of the inside circumferential surface of the bushing may be in the form of dimples, or, though not shown, a lattice form. However, the uneven surface is not limited to the above, and the uneven surface may be any form which causes interference between the element thereby increasing a contact area to prevent break away between elements, such as dot formed projections from the inside circumferential surface of the bushing 50*b*.

According to the fourth embodiment of the present invention, during fabrication of the igniter 50, the adhesive 50*d* is injected inside the bushing 50*b* when the bushing 50*b* is inserted about the first body 510*a* of the igniter element 50*a*. The igniter element 50*a* and the bushing 50*b* are joined as the adhesive 50*d* sets. According to the fourth embodiment of the present invention, if system vibration occurs when the igniter 50 is mounted with a slope in a dryer having the igniter 50, the uneven surface 501*b* prevents the adhesive 50*d* from slipping backward. Thus, break away of the igniter element 50*a* joined with the adhesive 50*d* from the bushing 50*b* is prevented.

The joining force between the uneven surface 501*b* on the inside circumferential surface of the bushing 50*b* and the adhesive 50*d* injected into the inside of the bushing which sets such that the adhesive 50*d* complements the uneven surface on the inside circumferential surface of the bushing prevents break away of the components from each other.

Figure 11:
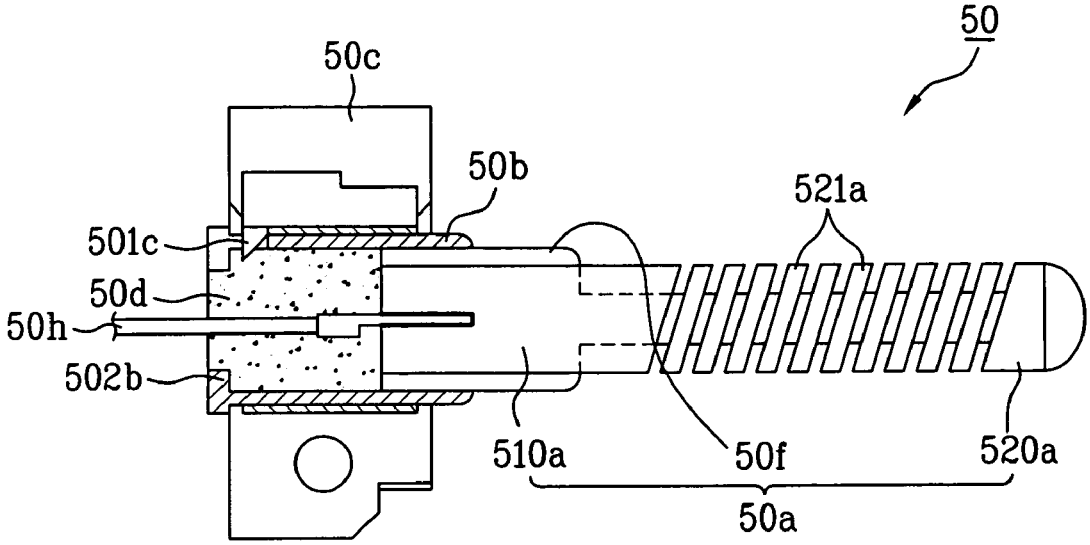
FIG. 11 illustrates a front view of an improved igniter in accordance with a fifth embodiment of the present invention.

Next, FIG. 11 illustrates a front view, of an improved igniter in accordance with a fifth embodiment of the present invention. As shown, the igniter 50 includes a flange 502*b* projecting inward of the bushing 50*b* from an end thereof inserted about an outside of the first body 510*a* of the igniter element 50*a*.

According to the fifth embodiment of the present invention, as system vibration occurs when the igniter 50 is mounted with a slope in a dryer having the igniter 50 of the fifth embodiment applied thereto, the flange 502*b* is a stopper which prevents the adhesive 50*d* from slipping backward. Therefore, break away of the igniter element 50*a* joined with the adhesive 50*d* from the bushing 50*b* is prevented.

Figure 12:
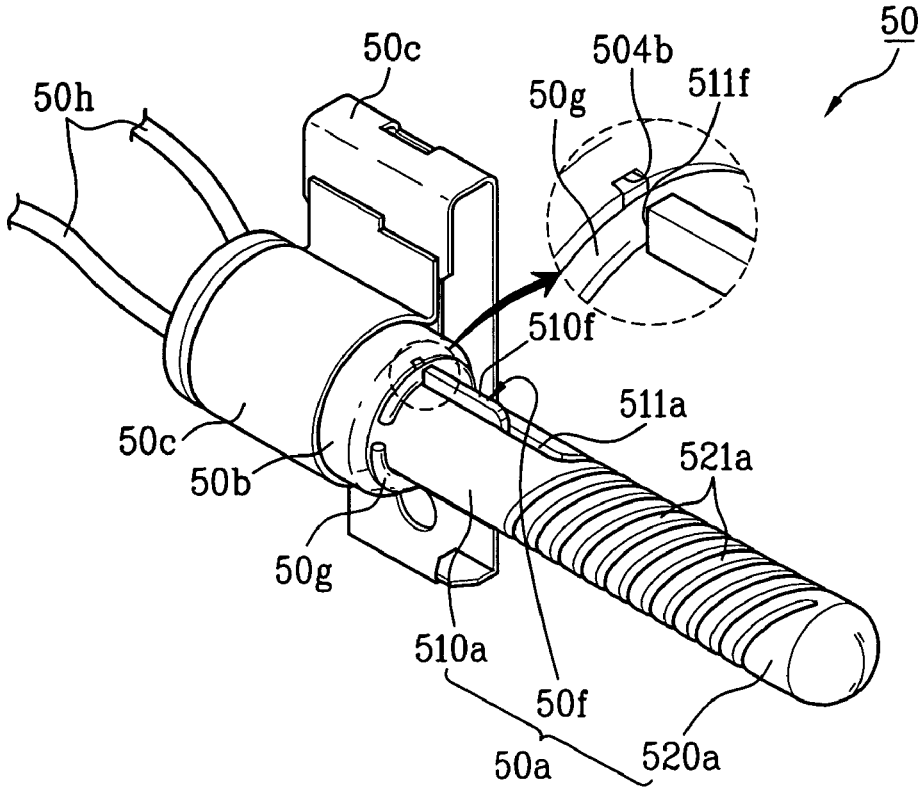
FIG. 12 illustrates a perspective view of an improved igniter in accordance with a sixth embodiment of the present invention.

FIG. 12 illustrates a perspective view of an improved igniter in accordance with a sixth embodiment of the present invention. Referring to FIG. 12, the large width part 510*f* of the polarizing key 50*f* has a key slot 511*f*. A snap ring 50*g* formed with a non-conductive material is mounted in the key slot 511*f* for preventing displacement of the polarizing key 50*f* with respect to the bushing 50*b*, thereby preventing break away of the igniter element 50*a*.

According to the sixth embodiment of the present invention, if system vibration occurs when the igniter 50 is mounted with a slope such that a front side is higher than a rear side in a dryer having the igniter 50, the snap ring 50*g*, which is positioned in the key slot 511*f* in the polarizing key 50*f* joined with the adhesive 50*d*, is a stopper which prevents the polarizing key 50*f* and the adhesive 50*d* joined thereto from slipping backward. Thus, the break away of the igniter element 50*a* joined with the adhesive 50*d* from the bushing 50*b* is prevented.

The snap ring 50*g* may be replaced with a washer having a cut out portion so as to have elasticity.

The sixth embodiment prevents break away of the igniter element 50*a* from the bushing 50*b* regardless of the sloped or horizontal mounting of the igniter 50 when applying the igniter 50 to a dryer or the like.

Figure 13:
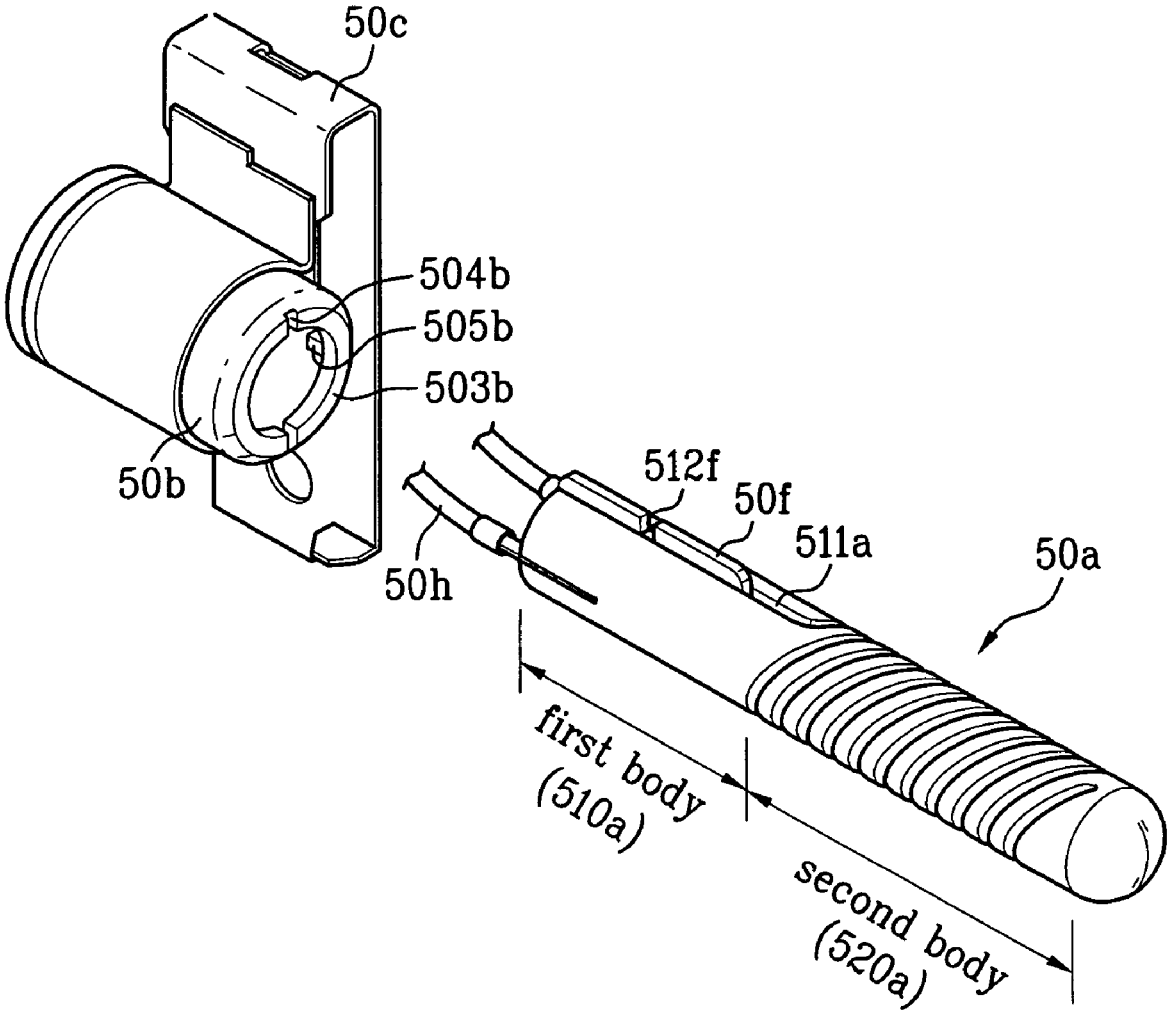
FIG. 13 illustrates a perspective view of an improved igniter in accordance with a seventh embodiment of the present invention.

FIG. 13 illustrates a perspective view of an improved igniter in accordance with a seventh embodiment of the present invention.

Referring to FIG. 13, a stopper flange 503*b* projects inward of the bushing 50*b* from an end of the bushing 50*b* in contact with the igniter element 50*a*.

The stopper flange 503*b* has guide slots 504*b* at two points along a circumferential direction of the stopper flange 503*b*. The guide slots 504*b* guide the large width part 510*f* of the polarizing key 50*f* when the bushing 50*b* is inserted onto a side of the second body 520*a* of the igniter element 50*a*.

The polarizing key 50*f* has a bushing stopper slot 512*f* in each of opposite edges of the large width part 510*f*. The bushing stopper slots 512*f* allows insertion of the stopper flange 503*b* into the bushing stopper slot 512*f* when the bushing 50*b* is rotated after the bushing is inserted to a certain position. Once the stopper flange 503*b* is inserted into the bushing stopper slot 512*f*, the bushing 50*b* is firmly fixed to the igniter element 50*a*.

The bushing 50*b* may have a stopper projection 505*b* on an inside circumferential surface of the bushing 50*b*. The polarizing key 50*f* is caught at the stopper projection 505*b* when the bushing 50*b* is rotated such that the stopper flange 503*b* of the bushing 50*b* is positioned in the bushing stopper slots 512*f*, thereby preventing any further rotation of the bushing 50*b*.

According to the seventh embodiment of the present invention, as system vibration occurs when the igniter 50 is mounted with a slope such that a front side is higher than a rear side in a dryer having the igniter 50 of FIG. 13 applied thereto, the stopper flange 503*b* of the bushing 50*b* fitted to the bushing stopper slots 512*f* in the polarizing key 50*f* prevents the polarizing key 50*f* and the adhesive 50*d* joined therewith from slipping backward. Likewise, the break away of the igniter element 50*a* joined with the adhesive 50*d* from the bushing 50*b* can be prevented effectively at the end.

In summary, by forming the bushing stopper slots 512*f* in the polarizing key 50*f* and the stopper flange on the bushing 50*b*, the igniter element 50*a* can be fixed to the bushing 50*b* by interference between the stopper flange 503*b* and the bushing stopper slots 512*f* as the bushing 50*b* is turned when the bushing 50*b* is inserted to a certain position on the polarizing key 50*f*.

The seventh embodiment effectively prevents break away of the igniter element 50*a* from the bushing 50*b* regardless of the sloped or horizontal mounting of the igniter 50 when the igniter 50 is used with a dryer or the like.

Figure 14:
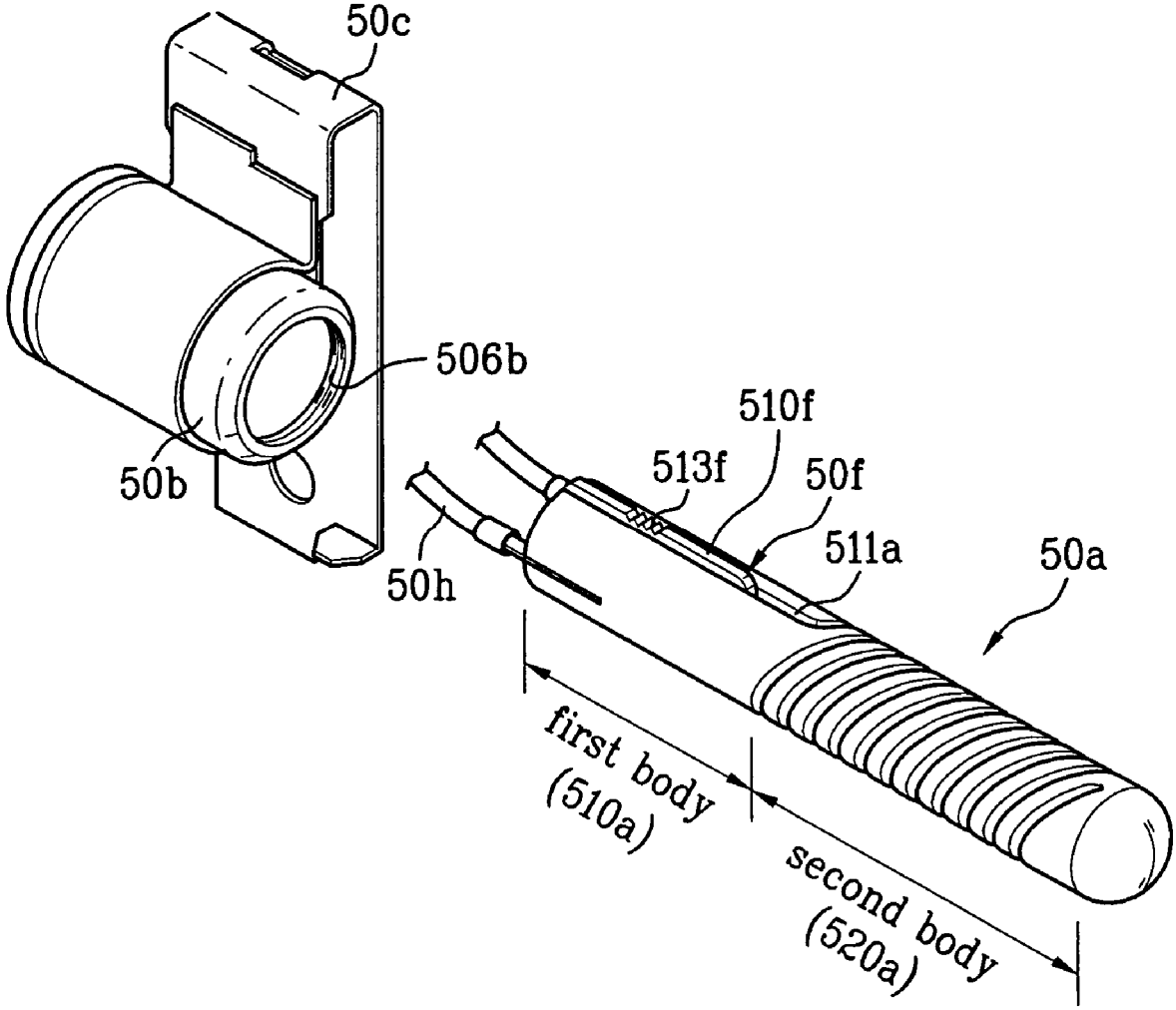
FIG. 14 illustrates a disassembled perspective view of an improved igniter in accordance with an eighth embodiment of the present invention.

FIG. 14 illustrates a disassembled perspective view of an improved igniter in accordance with an eighth embodiment of the present invention. Referring to FIG. 14, a male thread is formed on the large width part 510*f* of the polarizing key 50*f*, and a female thread 506*b* is formed in an inside circumferential surface of the bushing 50*b* which complements the male thread in the large width part 510*f*.

According to the eighth embodiment of the present invention, since the bushing 50*b* is fastened with the polarizing key 50*f* using the previously described male and female threads when the bushing 50*b* is mounted on the igniter element 50*a*, even if vibration from the system is transmitted to the igniter 50, break away of the igniter element 50*a* is prevented.

As discussed with reference to the sixth embodiment, the eighth embodiment effectively prevents break away of the igniter element 50*a* from the bushing 50*b* regardless of the sloped or horizontal mounting of the igniter 50 when the igniter 50 is used with a dryer or the like.

Since the thread fastening between the bushing 50*b* and the polarizing key 50*f* prevents slip of the adhesive 50*d* joined with the polarizing key 50*f* in any direction, break away of the igniter element 50*a* from the bushing 50*b* is prevented at the end.

It is apparent that the igniters of the fourth to eighth embodiments as shown in FIGS. 10 to 14 can be embodied individually undoubtedly, or combined with the first to third embodiments.

Using the sealant 50*e* together with the structural changes of the bushing 50*b* and/or the polarizing key 50*f* enhances prevention of component break away of the igniter 50.

The technical aspects and systems shown in the first to eighth embodiments of the present invention are applicable to the other types of igniters shown in FIGS. 5A–5D.

Thus, the systems in accordance with different embodiments of the present invention for prevention of break away of the components of the igniter are applicable individually, or in combination, not only to igniters of a type in which the bracket 50*c* is fastened to the bushing 50, but also to igniters of a type in which the igniter has the bushing 50*b* fastened by separate means without the bracket 50*c*.

In the second to eighth embodiments, all materials that have a bonding force and heat resistance, such as silicone, epoxy resin, or EMC, may be used for the sealant 50*e*.

Figure 15:
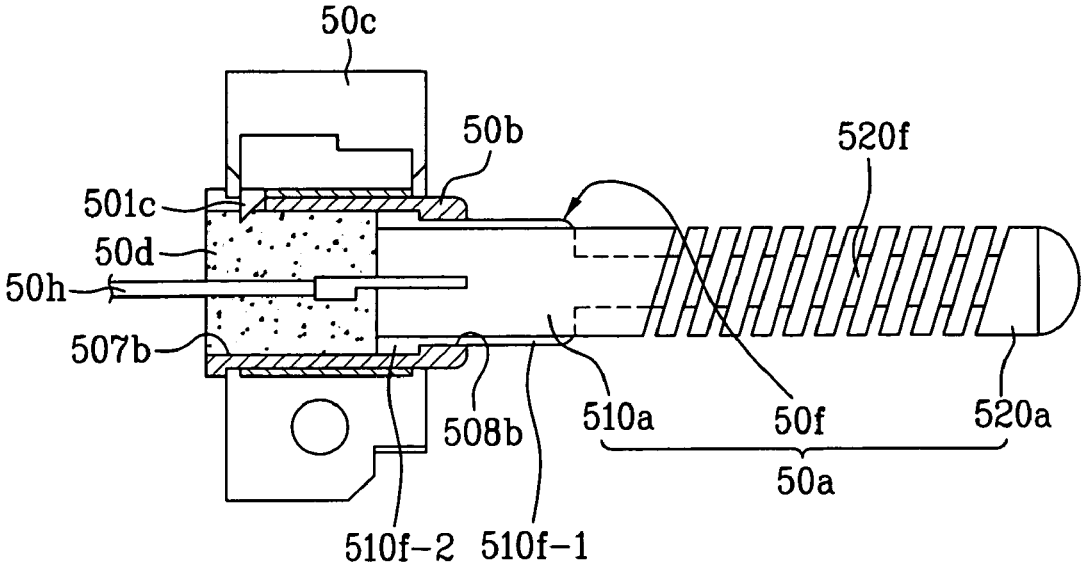
FIG. 15 illustrates a front view of an improved igniter in accordance with a ninth embodiment of the present invention.

FIG. 15 illustrates a front view of an improved igniter in accordance with a ninth embodiment of the present invention.

Referring to FIG. 15, a step is formed in each of an inside circumferential surface of the bushing 50*b* and an outside circumferential surface of the polarizing key 50*f*. In more detail, the inside circumferential surface of the bushing 50*b* inserted on the first body 510*a* of the igniter element 50*a* has a large diameter part 507*b* and a small diameter part 508*b*. The large diameter part 507*b* is formed where a part of the adhesive 50*d* is placed therein, and the small diameter part 508*b* is formed in a part opposite to the part the adhesive is placed therein. This structure provides the step between the large diameter part 507*b* and the small diameter part 508*b*. The large width part 510*f* of the polarizing key has a first large width part 510*f*-1 and a second large width part 510*f*-2. The small diameter part 508*b* receives the first large width part 510*f*-1 when the first body 510*a* is inserted in the bushing 50*b*. The first large width part 510*f*-1 has a size equal to or slightly smaller than a diameter of the small diameter part 508*b* of the bushing 50*b*. The large diameter part 507*b* receives the second large width part 510*f*-2. The second large width part 510*f*-2 has a size equal to or slightly smaller than the large diameter part 507*b*.

The igniter 50 in accordance with a ninth embodiment of the present invention is provided with a structure for easy positioning of insertion of the bushing during fabrication of the igniter, and a structure for preventing the igniter element 50*a* from breaking away in a forward direction due to vibration.

The igniter 50 in accordance with a ninth embodiment of the present invention automatically fixes an inserting position of the bushing 50*b* by providing the step of the polarizing key 50*f* and inserting the bushing 50 into the igniter 50 from front to rear.

To further illustrate, as the large diameter part 507*b* of the bushing 50*b* is fit to the second large width part 510*f*-2 of the polarizing key 50*f*, the inserting position of the bushing 50*b* with respect to the polarizing key 50*f* is fixed, automatically. Thus, the easy positioning of the bushing during fabrication of the igniter 50 improves productivity.

Moreover, when an igniter has the foregoing structures, even if the bonding force of the adhesive 50*d* is weakened by vibration applied from an exterior for a period of time, a front direction break away of the igniter element 50*a* from the bushing is prevented.

Figure 16:
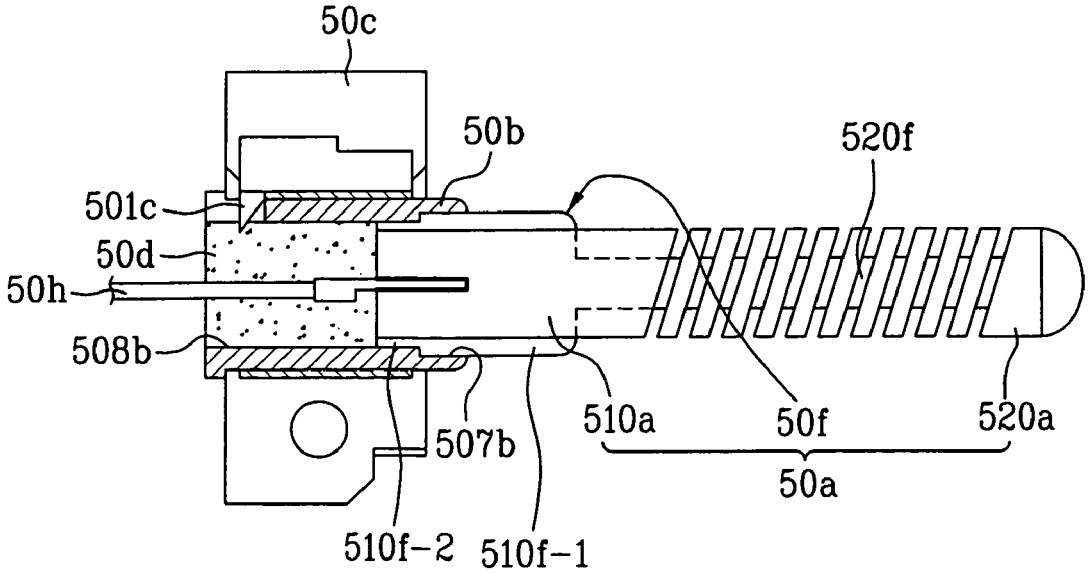
FIG. 16 illustrates a front view of an improved igniter in accordance with a tenth embodiment of the present invention.

FIG. 16 illustrates a front view of an improved igniter in accordance with a tenth embodiment of the present invention.

Referring to FIG. 16, a step is formed inside a circumferential surface of the bushing 50*b* and an outside circumferential surface of the polarizing key 50*f*. In more detail, the inside circumferential surface of the bushing 50*b* inserted on the first body 510*a* of the igniter element 50*a* has a large diameter part 507*b* and a small diameter part 508*b*. The small diameter part 508*b* is formed where a part of the adhesive 50*d* is placed therein, and the large diameter part 507*b* is formed in a part opposite to the part where the adhesive is placed. This structure provides the step between the large diameter part 507*b* and the small diameter part 508*b*. The large width part 510*f* of the polarizing key 50*f* has a first large width part 510*f*-1 and a second large width part 510*f*-2. The large diameter part 507*b* receives the first large width part 510*f*-1 when the first body 510*a* is inserted in the bushing 50*b*. The first large width part 510*f*-1 has a size equal to or slightly smaller than a diameter of the large diameter part 507*b* of the bushing 50*b*. The small diameter part 508*b* receives the second large width part 510*f*-2. The second large width part 510*f*-2 has a size equal to or slightly smaller than the small diameter part 508*b*.

As discussed with reference to the ninth embodiment, the igniter 50 in accordance with the tenth embodiment of the present invention has a structure for easy positioning and insertion of the bushing during fabrication of the igniter, and a structure for preventing the igniter element 50*a* from breaking away in a forward direction due to vibration.

The igniter 50 in accordance with a the tenth embodiment of the present invention fixes an inserting position of the bushing 50*b* automatically by providing the step of the polarizing key 50*f* and inserting the bushing 50 into the igniter 50 from rear to front.

As the large diameter part 507*b* of the bushing 50*b* is fit to the first large width part 510*f*-1 of the polarizing key 50*f*, the inserting position of the bushing 50*b* with respect to the polarizing key 50*f* is fixed, automatically. Thus, the easy positioning of the bushing in fabrication of the igniter 50 improves productivity.

Moreover, when an igniter has the foregoing structures, if the bonding force of the adhesive 50*d* is weakened by vibration from an exterior for a period of time, rear direction break away of the igniter element 50*a* from the bushing is prevented.

Figure 17:
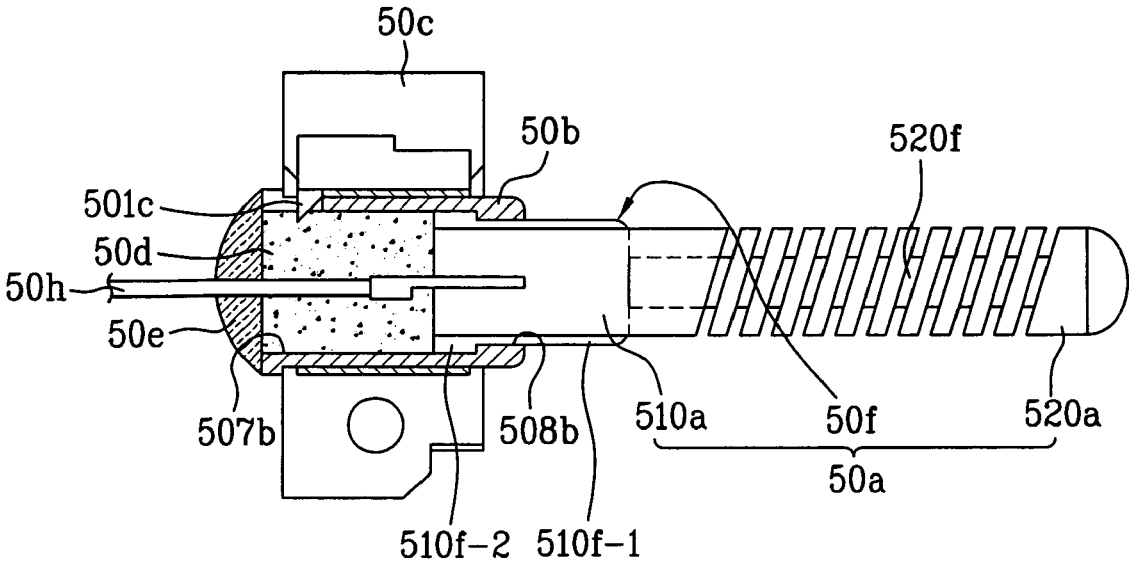
FIG. 17 illustrates a section view of an improved igniter in accordance with an eleventh embodiment of the present invention.

FIG. 17 illustrates a section of an improved igniter in accordance with an eleventh embodiment of the present invention. The eleventh embodiment has a structure similar to the ninth embodiment described with reference to FIG. 15 and includes the sealant 50*e*. The sealant 50*e* is coated on a surface of the bushing 50*b* in which the adhesive 50*d* is inserted thereby covering both the adhesive 50*d* and the bushing 50*b*. The sealant 50*e* may be any material having silicone or epoxy resin, EMC (Epoxy Molding Compound), or the like.

If the igniter has the foregoing structures, the igniter has all the advantages of the embodiment described with reference to FIG. 6 and the embodiment described with reference to FIG. 15. Description of the advantages, given already, will be omitted.

Figure 18:
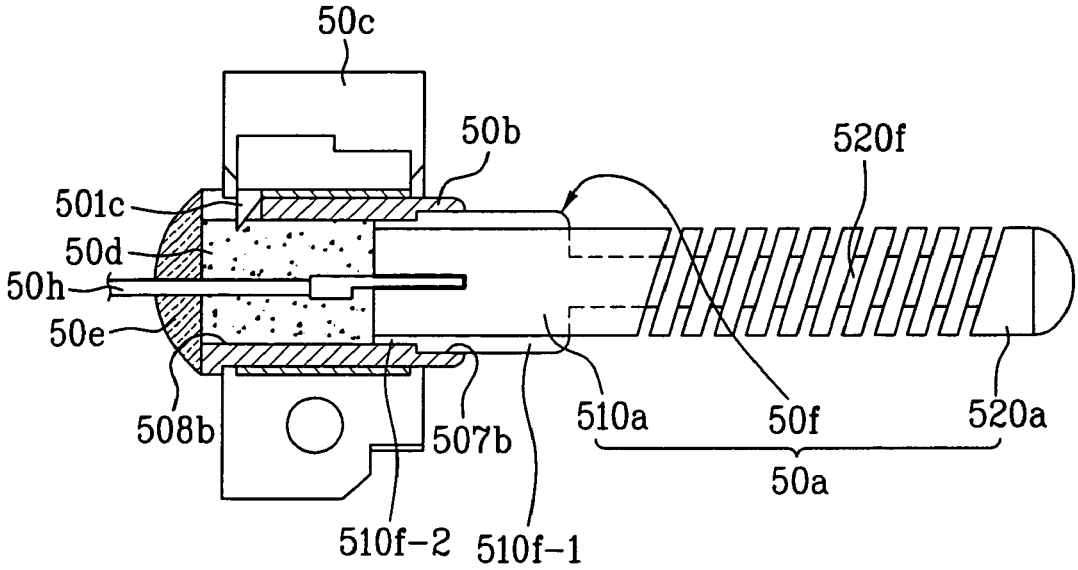
FIG. 18 illustrates a section view of an improved igniter in accordance with a twelfth embodiment of the present invention.

FIG. 18 illustrates an improved igniter in accordance with a twelfth embodiment of the present invention. The twelfth embodiment has the structure of the tenth embodiment described with reference to FIG. 16 and includes a sealant 50*e*. The sealant 50*e* is coated on a surface of the bushing 50*b* in which the adhesive 50*d* is inserted thereby covering both the adhesive 50*d* and the bushing 50*b*. The sealant 50*e*, may be any material having a bonding force and heat resistance such as silicone or epoxy resin, EMC (Epoxy Molding Compound), or the like.

If the igniter has the foregoing structures, the igniter has all the advantages of the embodiment described with reference to FIG. 6 and the embodiment described with reference to FIG. 16. Description of the advantages, given already, will be omitted.

The technical aspects and systems shown in the eleventh and twelfth embodiments of the present invention are applicable to other types of igniters, fully.

For example, the systems in accordance with different embodiments of the present invention which prevent break away of the components of the igniter are applicable individually, or in combination, not only to igniters of a type in which the bracket 50*c* is fastened to the bushing 50, but also to igniters of a type in which the igniter has the bushing 50*b* fastened by separate means without the bracket 50*c*.

Thus, the present invention can prevent break away of components of an igniter positively if vibration takes place at the system the igniter is mounted therein by applying sealant 50*e* for securing a bonding force between the components of the igniter, or by changing, or combining structures of the components of the igniter.

Also, the present invention can improve ease of assembly during fabrication of the igniter and prevent break away of components of an igniter if vibration takes place at the system of a dryer to which the igniter is mounted. This may be accomplished by changing structures of the components of the igniter to ease assembly of the components and applying sealant 50*e* to the igniter to secure a bonding force between the components.

It will be apparent to those skilled in the art that various modifications and variations can be made in the present invention without departing from the spirit or scope of the invention.

Embodiments described with reference to FIGS. 8–14 may be combined with the embodiments described with reference to FIGS. 15 and 16. Also, embodiments described with reference to FIGS. 10–14 may be combined with the embodiments described with reference to FIGS. 17 and 18.

[1] Thus, it is intended that the present invention cover the modifications and variations of this invention provided they come within the scope of the appended claims and their equivalents.

What is claimed is:

1. An igniter comprising:

an igniter element having a polarizing key;

a bushing inserted on an outside of one end of the igniter element;

an adhesive placed in a cavity of the bushing for bonding the bushing with the one end of the igniter element;

sealant covering both the bushing and the adhesive placed in the cavity of the bushing, the sealant joining the bushing and adhesive; and a stop for preventing the igniter element from moving with respect to the bushing.

2. The igniter as claimed in claim 1, wherein the igniter element includes:

a cylindrical hollow first body having straight slots extending in a length direction;

a second body extending in a length direction from the cylindrical hollow first body, the second body having helical bands formed along a length direction of the second body starting from the slots; wherein the polarizing key is inserted in the first and second bodies, the polarizing key having a lead line connected thereto.

3. The igniter as claimed in claim 2, wherein the first and second bodies are formed of a non-metallic resistant material.

4. The igniter as claimed in claim 3, wherein the non-metallic resistant material is silicon carbide.

5. The igniter as claimed in claim 2, wherein the polarizing key further includes:

a large width part of a plate in the first body having a part exposed to an exterior through the slots; and a small width part in the second body extending from the large width part.

6. The igniter as claimed in claim 1, the igniter further comprising a bracket fastened to an outside surface of the bushing.

7. The igniter as claimed in claim 1, wherein the sealant is one selected from the group consisting of silicone, epoxy, and EMC (Epoxy Molding Compound).

8. The igniter as claimed in claim 1, wherein the adhesive is ceramic cement.

9. The igniter as claimed in claim 1, wherein the sealant is coated on a side of the bushing opposite to a side the igniter element is in contact therewith, the sealant covering both the adhesive and the bushing.

10. The igniter as claimed in claim 1, wherein the sealant is coated on a side of the bushing contacting the igniter element such that the sealant covers both the bushing and an area of an outside circumferential surface of the igniter element.

11. The igniter as claimed in claim 1, wherein the adhesive is placed in a part of the cavity of the bushing, and the sealant is placed in the remainder of the cavity.

12. The igniter as claimed in claim 1, wherein the adhesive is placed in substantially one half of the cavity, and the sealant is placed in the remainder of the cavity.

13. The igniter as claimed in claim 1, wherein the bushing includes means for preventing the adhesive from moving in a length direction of the bushing and for increasing a bonding force with the adhesive.

14. The igniter as claimed in claim 13, wherein the means is an uneven surface formed in an inside circumferential surface of the bushing.

15. The igniter as claimed in claim 14, wherein the uneven surface has a dimple.

16. The igniter as claimed in claim 15, wherein the uneven surface has a lattice.

17. The igniter as claimed in claim 13, wherein the means is a flange extending inwardly from the bushing.

18. The igniter as claimed in claim 17, wherein the flange is formed at a side of the bushing opposite a side in contact with the igniter element.

19. The igniter as claimed in claim 1, wherein the means includes:

key slots in an outside surface of the polarizing key; and a snap ring inserted on an outside circumference of the igniter element such that the snap ring contacts the bushing when the snap ring is inserted in the key slots thereby preventing the igniter element from moving toward the bushing.

20. The igniter as claimed in claim 19, wherein the snap ring is formed of a non-metallic material.

21. The igniter as claimed in claim 1, wherein the means includes:

a stopper flange disposed on the bushing, the stopper flange projecting inwardly from a side the bushing is in contact with the igniter;

guide slots in the stopper flange, the guide slots guiding opposite side surfaces of the polarizing key when the bushing is inserted in the igniter element; and bushing stopper slots, the bushing stopper slots receiving the stopper flange to limit a length direction movement of the bushing and the igniter element when the bushing is turned after the igniter element is inserted in the bushing.

22. The igniter as claimed in claim 21, wherein the means includes a stopper projection for limiting a rotation angle of the bushing when the bushing is rotated when the stopper flange is inserted in the bushing stopper slots.

23. The igniter as claimed in claim 1, wherein the means includes:

a male thread formed in an outside circumferential surface of the polarizing key; and a female thread on an inside circumferential surface of the bushing for engaging with the male thread in the polarizing key.

24. The igniter as claimed in claim 1, wherein the stop includes:

a step on an inside circumferential surface of the bushing; and a step on an outside circumferential surface of the polarizing key where the polarizing key step engages with the step on the bushing thereby preventing the igniter element from moving toward any side of a length direction of the igniter.

25. The igniter as claimed in claim 24, wherein the bushing is fastened to the igniter element as the bushing is inserted from a fore end of the igniter element to a rear end of the igniter element to which a lead line is connected.

26. The igniter as claimed in claim 25, wherein the step on the bushing is formed at a boundary surface between a small diameter part formed on an inside circumferential surface of the bushing at a side of the bushing where a rear end of the igniter element is in direct contact therewith, and a large diameter part formed on the inside circumferential surface of the bushing so as to be in contact with the small diameter part where the step on the polarizing key is formed at a boundary surface between a first large width part in contact with the small diameter part at rear end side of the igniter element and a second large width part on the outside circumferential surface of the polarizing key so as to be in contact with the large diameter part.

27. The igniter as claimed in claim 24, wherein the bushing is inserted from a rear end of the igniter element to a fore end of the igniter element.

28. The igniter as claimed in claim 27, wherein the step on the bushing is formed at a boundary surface between a large diameter part formed on an inside circumferential surface of the bushing at a side of the bushing in direct contact with a rear end of the igniter element, and a small diameter part formed on the inside circumferential surface of the bushing so as to be in contact with the large diameter part, where the step on the polarizing key is formed at a boundary surface between a first large width part in contact with the large diameter part at rear end side of the igniter element and a second large width part on the outside circumferential surface of the polarizing key so as to be in contact with the small diameter part.

29. An igniter comprising:

an igniter element having a polarizing key for generating heat at a high temperature;

a bushing inserted on an outside of one end of the igniter element;

an adhesive placed in a cavity of the bushing, the adhesive bonding the bushing with the one end of the igniter element; and a means for preventing movement of the igniter element in a length direction with respect to the bushing.

30. The igniter as claimed in claim 29, wherein the igniter element includes:

a cylindrical hollow first body having straight slots extending in a length direction;

a second body extending in a length direction from the cylindrical hollow first body part, the second body having helical bands formed along a length direction of the second body starting from the slots; and a polarizing key inserted in the first and second bodies, the polarizing key having a lead line connected thereto.

31. The igniter as claimed in claim 30, wherein the first and second bodies are formed of a non-metallic resistant material.

32. The igniter as claimed in claim 29, further comprising a bracket fastened to an outside surface of the bushing.

33. The igniter as claimed in claim 29, wherein the means includes:

key slots in an outside surface of the polarizing key; and a snap ring inserted on an outside circumference of the igniter element such that the snap ring contacts the bushing when the snap ring is inserted in the key slots in contact with the bushing thereby preventing the igniter element from moving toward the bushing.

34. The igniter as claimed in claim 29, wherein the means includes:

a stopper flange on the bushing, the stopper flange projecting inwardly from a side of the bushing in contact with the igniter;

guide slots disposed in the stopper flange, the guide slots guiding opposite side surfaces of the polarizing key when the bushing is inserted in the igniter element; and bushing stopper slots, the bushing stopper slots receiving the stopper flange when the bushing is turned after the igniter element is inserted in the bushing thereby limiting a length direction movement of the bushing and the igniter element.

35. The igniter as claimed in claim 34, wherein the means includes a stopper projection for limiting a rotation angle of the bushing when the bushing is rotated as the stopper flange is inserted in the bushing stopper slots.

36. The igniter as claimed in claim 29, wherein the means includes:

a male thread formed in an outside circumferential surface of the polarizing key; and a female thread on an inside circumferential surface of the bushing, the female thread engaging with the male thread in the polarizing key.

37. The igniter as claimed in claim 29, wherein the means includes:

a step on an inside circumferential surface of the bushing; and a step on an outside circumferential surface of the polarizing key so as to be engaged with the step on the bushing for preventing the igniter element from moving toward any side of a length direction.

38. The igniter as claimed in claim 37, wherein the bushing is fastened to the igniter element as the bushing is inserted from a fore end of the igniter element to a rear end of the igniter element to which a lead line is connected.

39. The igniter as claimed in claim 38, wherein the step on the bushing is formed at a boundary surface between a small diameter part formed on an inside circumferential surface of the bushing at a side of the bushing where a rear end of the igniter element is in direct contact therewith, and a large diameter part formed on the inside circumferential surface of the bushing so as to be in contact with the small diameter part where the step on the polarizing key is formed at a boundary surface between a first large width part in contact with the small diameter part at rear end side of the igniter element and a second large width part on the outside circumferential surface of the polarizing key so as to be in contact with the large diameter part.

40. The igniter as claimed in claim 37, wherein the bushing is inserted from a rear end of the igniter element to a fore end of the igniter element.

41. The igniter as claimed in claim 40, wherein the step on the bushing is formed at a boundary surface between a large diameter part formed on an inside circumferential surface of the bushing at a side of the bushing where a rear end of the igniter element is in direct contact therewith, and a small diameter part formed on the inside circumferential surface of the bushing so as to be in contact with the large diameter part where the step on the polarizing key is formed at a boundary surface between a first large width part in contact with the large diameter part at rear end side of the igniter element and a second large width part on the outside circumferential surface of the polarizing key so as to be in contact with the small diameter part.

42. The igniter as claimed in claim 37, further comprising sealant coated on a side of the bushing opposite to a side the igniter element contacts the bushing, to cover both the adhesive and the bushing.

43. The igniter as claimed in claim 37, further comprising sealant coated on a side of the bushing which contacts the igniter element, to cover both the bushing and an area of an outside circumferential surface of the igniter element.

44. The igniter as claimed in claim 42, wherein the adhesive is placed in a part of the cavity of the bushing, and the sealant is placed in a remainder of the cavity.

45. The igniter as claimed in claim 42, wherein the adhesive is placed in substantially one half of the cavity, and the sealant is placed in a remainder of the cavity.

46. A dryer comprising:

a cabinet;

a drum rotatably mounted in the cabinet for holding a drying object; and a burner inside of the cabinet for generating heated air, the burner having an igniter for igniting fuel supplied from an exterior, the igniter including:

an igniter element having a polarizing key;

a bushing inserted on an outside of one end of the igniter element;

adhesive placed in a cavity of the bushing for bonding the bushing with the one end of the igniter element;

sealant covering both the bushing and the adhesive placed in the cavity of the bushing for joining the bushing and adhesive; and a stop for preventing the igniter element from moving with respect to the bushing.

47. The dryer as claimed in claim 46, wherein the sealant is coated on a side of the bushing opposite to a side of the bushing in contact with the igniter element thereby covering both the adhesive and the bushing.

48. The dryer as claimed in claim 46, wherein the sealant is coated on side of the bushing which contacts the igniter element thereby covering both the bushing and an area of an outside circumferential surface of the igniter element.

49. The dryer as claimed in claim 46, wherein the adhesive is placed in a part of the cavity of the bushing, and the sealant is placed in a remainder of the cavity.

50. The dryer as claimed in claim 46, wherein the adhesive is placed in substantially one half of the cavity, and the sealant is placed in a remainder of the cavity.

51. The dryer as claimed in claim 46, wherein the sealant is one selected from the group consisting of silicone, epoxy, and EMC.

52. The dryer as claimed in claim 46, wherein the bushing includes an uneven surface formed in an inside circumferential surface.

53. The dryer as claimed in claim 46, wherein the bushing further includes a flange part projecting inwardly from a surface which contacts the igniter element.

54. The dryer as claimed in claim 46, wherein the igniter includes:

key slots in an outside surface of the polarizing key; and a snap ring inserted on an outside circumference of the igniter element such that the snap ring contacts the bushing when the snap ring is inserted in the key slots in contact with the bushing thereby preventing the igniter element from moving toward the bushing.

55. The dryer as claimed in claim 46, wherein the igniter includes:

a stopper flange disposed on the bushing, the stopper flange projecting inwardly from a side the bushing is in contact with the igniter;

guide slots in the stopper flange, the guide slots guiding opposite side surfaces of the polarizing key when the bushing is inserted in the igniter element, and bushing stopper slots, the bushing stopper slots receiving the stopper flange to limit a length direction movement of the bushing and the igniter element when the bushing is turned after the igniter element is inserted in the bushing.

56. The dryer as claimed in claim 55, wherein the igniter further includes a stopper projection for limiting a rotation angle of the bushing when the bushing is rotated when the stopper flange is inserted in the bushing stopper slots.

57. The dryer as claimed in claim 46, wherein the igniter further includes:

a male thread formed in an outside circumferential surface of the polarizing key; and a female thread on an inside circumferential surface of the bushing for engaging with the male thread in the polarizing key.

58. The dryer as claimed in claim 46, wherein the stop includes:

a step on an inside circumferential surface of the bushing; and a step on an outside circumferential surface of the polarizing key where the polarizing key step engages with the step on the bushing thereby preventing the igniter element from moving toward any side of a length direction of the igniter.

59. An igniter, the igniter comprising:

an igniter element;

a bushing disposed adjacent the igniter element;

an adhesive, the adhesive being disposed within the bushing, the adhesive bonding with both the bushing and the igniter such that the adhesive bonds both the bushing and the igniter element; and a stop for preventing the igniter element from moving with respect to the bushing.

60. The igniter as recited in claim 59, the igniter element further comprising:

a first body; and a second body opposite the first body wherein the first body is adjacent the bushing.

61. The igniter as recited in claim 60, the bushing further comprising:

a cavity wherein a portion of the igniter first body is disposed within the cavity.

62. The igniter as recited in claim 61, wherein the adhesive is substantially disposed within the bushing cavity.

63. The igniter as recited in claim 62, the igniter further comprising:

a sealant, the sealant being disposed on an end of the bushing where the sealant grips both the adhesive and the bushing such that the sealant maintains the position of the igniter element.

64. The igniter as recited in claim 63, wherein the sealant is disposed on an end of the bushing opposite the igniter first body.

65. The igniter as recited in claim 62, the igniter further comprising:

a sealant, the sealant being disposed on an end of the bushing which contacts the igniter element such that the sealant grips both the bushing and the igniter element thereby maintaining the position of the igniter element.

66. The igniter as recited in claim 60, the bushing further comprising:

an inside circumferential surface having an uneven surface where the adhesive is substantially disposed within the bushing inside circumferential surface.

67. The igniter as recited in claim 62, the bushing further comprising:

a flange disposed at an end of the bushing opposite the igniter first body wherein the adhesive is substantially disposed within the bushing between the igniter first body and the bushing flange.

68. The igniter as recited in claim 62, the igniter element further comprising:

a polarizing key, the polarizing key having:

a large width part; and a key slot;

a snap ring disposed on the key slot.

69. The igniter as recited in claim 68, the igniter further comprising:

a stopper flange, the stopper flange projecting inward from an end of the bushing adjacent the igniter element, the stopper flange engaging with a bushing stopper slot of the polarizing key.

70. The igniter as recited in claim 69, the stopper flange further comprising:

a stopper projection disposed along a circumference of the stopper flange, the stopper projections limiting a rotation angle when the stopper flange engages with the bushing stopper slot; and a guide slot disposed along the circumference of the stopper flange wherein the guide slots guide the polarizing key large width part.

71. The igniter as recited in claim 68, the bushing further comprising:

female threads disposed within an inner circumference of the bushing cavity.

72. The igniter as recited in claim 71, the polarizing key further comprising:

male threads disposed on the polarizing key large width part wherein the male threads complement the bushing female threads.

73. The igniter as recited in claim 68, the bushing further comprising:

a small diameter portion within the bushing cavity; and a large diameter portion within the bushing cavity adjacent the small diameter bushing such that the small diameter portion and the large diameter portion form a step within the bushing cavity.

74. The igniter as recited in claim 73, wherein the adhesive is disposed within the bushing large diameter portion.

75. The igniter as recited in claim 74, wherein the polarizing key large width part includes a first large width part and a second large width part adjacent the first large width part where the first large width part engages with the bushing small diameter portion and the second large width part engages with the bushing large diameter portion.

76. The igniter as recited in claim 75, the igniter further comprising:

a sealant, the sealant being disposed on an end of the bushing where the sealant grips both the adhesive and the bushing such that the sealant maintains the position of the igniter element.

77. The igniter as recited in claim 73, wherein the adhesive is disposed within the bushing small diameter portion.

78. The igniter as recited in claim 77, wherein the polarizing key large width part includes a first large width part and a second large width part adjacent the first large width part such that the first large width part engages with the bushing large diameter portion and the second large width part engages with the bushing small diameter portion.

79. The igniter as recited in claim 78, the igniter further comprising:

a sealant, the sealant being disposed on an end of the bushing where the sealant grips both the adhesive and the bushing wherein the sealant maintains the position of the igniter element.

80. A method of maintaining a position of an igniter during operation, the igniter having an igniter element having a first step, a bushing with a cavity and a second step, and an adhesive, the method comprising:

placing the bushing over a first end of the igniter element such that the first end of the igniter element is substantially within the bushing cavity, wherein the first step engages with the second step; and bonding the bushing with igniter wherein the adhesive is placed within the bushing cavity such that the adhesive bonds with both the bushing and the igniter element thereby maintaining the position of the igniter during operation.

81. The method of maintaining a position of an igniter as recited in claim 80, the method further comprising:

attaching a sealant at an end of the bushing such that the sealant grips both the adhesive and the bushing, thereby maintaining the position of the igniter during operation.

82. The method of maintaining a position of an igniter as recited in claim 80, wherein the igniter element includes:

a polarizing key, the polarizing key having:

a large width part; and bushing stopper slots.

83. The method of maintaining a position of an igniter as recited in claim 82, wherein the bushing includes an inwardly projecting stopper flange, the stopper flange having:

guide slots disposed along a circumference of the stopper flange; and stopper projections, the stopper projections being disposed along the stopper flange circumference.

84. The method of maintaining a position of an igniter as recited in claim 83, the operation of placing the bushing over a first end of the igniter further comprising:

guiding the polarizing key large width part with the guide slot; and engaging the stopper projections with the bushing stopper slots of the polarizing key.

85. The method of maintaining a position of an igniter as recited in claim 80, wherein the second step is formed by a small diameter part disposed within the bushing cavity and a large diameter part disposed within the bushing cavity adjacent the small diameter part.

86. The method of maintaining a position of an igniter as recited in claim 85, wherein the polarizing key large width part includes a first large width part and a second large width part adjacent the first large width part.

87. The method of maintaining a position of an igniter as recited in claim 86, the operation of placing the bushing over a first end of the igniter further comprising:

inserting the bushing over the igniter element from a fore end of the igniter element to a rear end of the igniter element.

88. The method of maintaining a position of an igniter as recited in claim 86, the operation of placing the bushing over a first end of the igniter further comprising:

inserting the bushing over the igniter element from a rear end of the igniter element to fore end of the igniter element.

* * * * *